US008262188B2

(12) United States Patent
Takahashi et al.

(10) Patent No.: US 8,262,188 B2
(45) Date of Patent: Sep. 11, 2012

(54) PRINTING DEVICE AND PRINTING METHOD

(75) Inventors: Toru Takahashi, Nagano (JP); Toru Miyamoto, Nagano (JP); Hirokazu Kasahara, Nagano (JP); Hideaki Kasahara, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 447 days.

(21) Appl. No.: 12/537,016

(22) Filed: Aug. 6, 2009

(65) Prior Publication Data

US 2010/0039466 A1 Feb. 18, 2010

(30) Foreign Application Priority Data

Aug. 12, 2008 (JP) ..... 2008-208161

(51) Int. Cl.
*B41J 29/393* (2006.01)
*B41J 2/01* (2006.01)
*B41J 2/155* (2006.01)

(52) U.S. Cl. ..... 347/19; 347/13; 347/42

(58) Field of Classification Search ..... 347/19
See application file for complete search history.

(56) References Cited

U.S. PATENT DOCUMENTS 6,076,915 A * 6/2000 Gast et al. ..... 347/19

FOREIGN PATENT DOCUMENTS

JP 2005-096368 A 4/2005

* cited by examiner

*Primary Examiner* — Julian Huffman
(74) *Attorney, Agent, or Firm* — Global IP Counselors, LLP

(57) ABSTRACT

A printing device includes a first nozzle column in which nozzles discharging liquid to a medium are arranged in a line in a predetermined direction, a second nozzle column in which nozzles discharging liquid to the medium are arranged in the predetermined direction, in which the first and second nozzle columns are arranged in a line in an intersecting direction with respect to the predetermined direction, a control portion which causes the first nozzle column and the second nozzle column to discharge the liquid to the medium while moving the first and second nozzle columns and the medium relatively to each other in a moving direction, in which the control portion forms a certain correction pattern composed of a first pattern formed by the first nozzle column and positioned on one side in the intersecting direction with respect to the moving direction and a second pattern formed by the second nozzle column and positioned on the other side in the intersecting direction with respect to the moving direction in parallel with the first pattern, and the correction pattern forms another correction pattern in which the distance between the second side end of the first pattern and the first side end of the second pattern in the intersecting direction with respect to the moving direction is different from that in the certain correction pattern.

8 Claims, 12 Drawing Sheets

| CORRECTION PATTERN NUMBER | DIAMETER OF DOT |
|---|---|
| 1 | 22.2 μm |
| 2 | 27.8 μm |
| 3 | 31.8 μm |
| 4 | 34.2 μm |
| 5 | 35.0 μm |

5.6 μm
4.0 μm
2.4 μm
0.8 μm

PRINTING DEVICE AND PRINTING METHOD

The entire disclosure of Japanese Patent Application No. 2008-208161, filed Aug. 12, 2008, is expressly incorporated by reference herein.

BACKGROUND

1. Technical Field

The present invention relates to a printing device and a printing method.

2. Related Art

There is a printing device which performs printing by moving a medium and a nozzle column, in which nozzles discharging liquid to the medium are arranged in a line, in a predetermined direction relatively to each other in a moving direction which intersects the predetermined direction. In such a printing device, if the nozzle column is inclined in a predetermined direction or the nozzle columns are misaligned with each other in a predetermined direction, dots are not formed at positions instructed by print data, resulting in deterioration in print quality.

In order to solve this problem, JP-A-2005-96368 discloses a method of detecting the inclination of the nozzle column with respect to a predetermined direction based on the overlapping of two correction patterns formed by two nozzle columns which are arranged in a direction which intersects the nozzle column direction.

The above detection method has a problem in which there is variance in the overlapping of the correction patterns due to the size of dots constituting the correction patterns. In such a case, there is a possibility that there will be false detections of the inclination of the nozzle column with respect to the predetermined direction and misalignment of the nozzle columns in the predetermined direction.

SUMMARY

An advantage of some aspects of the invention is to provide a printing device capable of detecting as precisely as possible the inclination of a nozzle column and misalignment of the nozzle columns in a nozzle column direction.

According to an aspect of the invention, there is provided a printing device including: a first nozzle column in which nozzles discharging liquid to a medium are arranged in a line in a predetermined direction; a second nozzle column in which nozzles discharging liquid to the medium are arranged in a line in the predetermined direction, in which the first and second nozzle columns are arranged in an intersecting direction with respect to the predetermined direction; a control portion which causes the first nozzle column and the second nozzle column to discharge the liquid to the medium while moving the first and second nozzle columns and the medium relatively to each other in a moving direction. The control portion forms a certain correction pattern composed of a first pattern formed by the first nozzle column and positioned on one side in the intersecting direction with respect to the moving direction and a second pattern formed by the second nozzle column and positioned on the other side in the intersecting direction with respect to the moving direction in parallel with the first pattern, and the correction pattern forms another correction pattern in which distance between a second side end of the first pattern and a first side end of the second pattern in the intersecting direction with respect to the moving direction is different from that in the certain correction pattern.

The other features of the invention will be apparent from the description of the present specification with reference to the accompanying drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
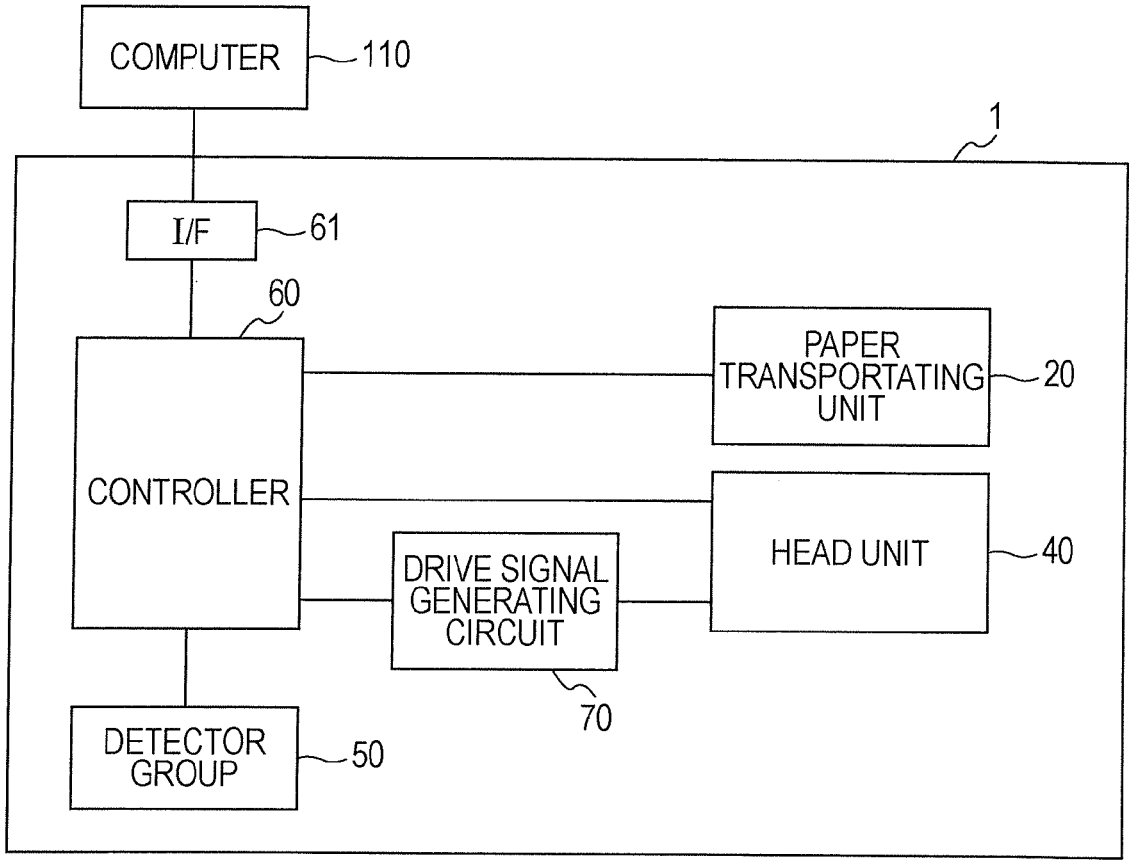
FIG. 1 is a block diagram for explaining the inside structure of a printer.

From the description of the present specification and the accompanying drawings, at least the followings will become apparent.

That is, a printing device includes: a first nozzle column in which nozzles discharging liquid to a medium are arranged in a line in a predetermined direction; a second nozzle column in which nozzles discharging liquid to the medium are arranged in a line in the predetermined direction, in which the first and second nozzle columns are arranged in an intersecting direction with respect to the predetermined direction; a control portion which causes the first nozzle column and the second nozzle column to discharge the liquid to the medium while moving the first and second nozzle columns and the medium relatively to each other in a moving direction. The control portion forms a certain correction pattern composed of a first pattern formed by the first nozzle column and positioned on one side in the intersecting direction with respect to the moving direction and a second pattern formed by the second nozzle column and positioned on the other side in the intersecting direction with respect to the moving direction in parallel with the first pattern, and the correction pattern forms another correction pattern in which distance between a second side end of the first pattern and a first side end of the second pattern in the intersecting direction with respect to the moving direction is different from that in the certain correction pattern.

According to the printing device, when detecting the inclination of the first and second nozzle columns with respect to the moving direction and the misalignment of the first and second nozzle columns in the predetermined direction on the basis of the distance (or gap) between the intersecting direction and the moving direction of the first pattern and the second pattern, it is possible to select the suitable correction pattern among a plurality of correction patterns and detect the inclination and misalignment of the nozzle columns with a high degree of precision.

According to such a printing device, the control portion differentiates the distance of the certain correction pattern from the distance of the other correction pattern by changing a size of dots formed by the first nozzle column and the second nozzle column.

According to the printing device, it is possible to change the distance between the first and second patterns.

According to such a printing device, out of the dot sizes which can be formed by the printing device, the control portion forms the certain correction pattern with dots having sizes as large as that the distance in the certain correction pattern approximately is zero.

According to the printing device, it is possible to detect with a high degree of precision the inclination and misalignment of the nozzle column, although the nozzle column is just slightly inclined or misaligned, because the background color of the medium is visible (that is, a white stripe is formed) due to a gap created between the first and second patterns or the first and second patterns overlap each other.

According to such a printing device, out of the dot sizes which can be printed by the printing device, the control portion forms the other correction pattern with dots having sizes as large as that the distances in the other correction patterns are almost zero.

According to the printing device, it is possible to form a correction pattern capable of detecting the inclination and misalignment of the nozzle column with a high degree of precision.

According to such a printing device, out of the dot sizes which can be formed by the printing device, the control portion forms the certain correction pattern with dots having sizes as large as that the distance in the certain correction pattern is approximate to a predetermined value.

According to the printing device, it is possible to detect the inclination and misalignment of the nozzle column with a high degree of precision.

According to such a printing device, the control portion forms the certain correction pattern such that the first pattern and the second pattern of the certain correction pattern do not overlap each other and the other correction pattern such that the first pattern and the second pattern of the other correction pattern do not overlap each other.

According to the printing device, it is possible to detect the inclination and misalignment of the nozzle column since a gap is formed between the first and second patterns and the background color of the medium is visible (i.e. a white stripe is formed), and therefore it is possible to detect the inclination and misalignment of the nozzle columns with a high degree of precision.

According to such a printing device, a color of liquid discharged from the first nozzle column and a color of liquid discharged from the second nozzle column are different from each other.

According to the printing device, since a region where the first pattern and the second pattern overlap each other is recognized by a color (secondary color) different from the color of the liquid of the first nozzle column and the color of the liquid of the second nozzle column, it is possible to detect the inclination and misalignment of the nozzle columns with a high degree of precision.

According to such a printing device, the color of the liquid discharged from the first nozzle column is yellow.

According to the printing device, since shading (brightness) severely changes at a border area between the first pattern and the regions at which the first pattern and the second pattern overlap each other, it is possible to precisely detect the inclination or the misalignment of the nozzle columns with a high degree of precision.

In addition, a printing method of a printing device having a first nozzle column in which nozzles discharging liquid to a medium are arranged in a line in a predetermined direction, a second nozzle column in which nozzles discharging liquid to a medium are arranged in a line in the predetermined direction and which is in parallel with the first nozzle column in an intersecting direction with respect to the predetermined direction, and a control portion for discharging liquid to a medium while relatively moving the first and second nozzle columns and the medium in a moving direction, the printing method includes: forming a certain correction pattern such that a first pattern formed by the first nozzle column is positioned on one side in an intersecting direction with respect to the moving direction and a second pattern formed by the second nozzle column is positioned on the other side in the intersecting direction with respect to the moving direction and is in parallel with the first pattern; and forming a correction pattern such that a distance between a second end of a first pattern and a first end of a second pattern thereof in the intersecting direction with respect to the moving direction is different from that in the certain correction pattern.

According to the printing device, when detecting the inclination of the first and second nozzle columns with respect to the moving direction and the misalignment of the first and second nozzle columns in the predetermined direction on the basis of the distance (or gap) between the intersecting direction and the moving direction of the first pattern and the second pattern, it is possible to select the suitable correction pattern among a plurality of correction patterns and detect the inclination and misalignment of the nozzle columns with a high degree of precision.

Line Head Printer

Figure 2:
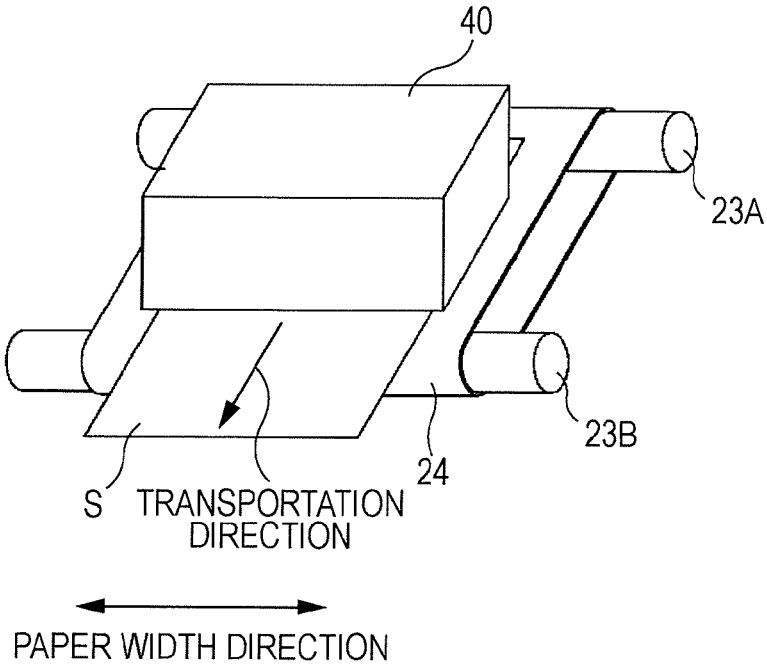
FIG. 2 is a perspective view for explaining the outline of a printer.

FIG. 1 is block diagram for explaining the inside structure of a printer 1. FIG. 2 is a perspective view for explaining the outline of the printer 1. Hereinafter, as the printer 1, a line head printer in which nozzles discharging liquid are lined up over the length of a width of paper (medium) is used as an example and will be described.

The printer 1 has a paper transporting unit 20, a head unit 40, a detector group 50, a controller 60, an interface 61, and a drive signal generating circuit 70. The printer 1 receives print data from a computer 110 via the interface 61. On the basis of the received data, the controller 60 in the printer 1 controls every portion (the paper transporting unit 20, the head unit 40, and the drive signal generating unit 70) of the printer 1 and prints out an image to paper S.

The paper transporting unit 20 transports the medium (for example, paper S) in a predetermined transportation direction (corresponding to a moving direction). The paper transporting unit 20 includes a paper supply roller (not shown), a transporting motor (not shown), an upstream transporting roller 23A, a downstream transporting roller 23B, and a belt 24. The paper supply roller is a roller for supplying paper S inserted into a paper insertion hole to the printer. When the transporting motor rotates, the upstream transporting roller 23A and the downstream transporting roller 23B drive the rotation belt to rotate. The paper S supplied by the paper supply roller 21 is transported to a printable region (a region at which the paper faces the head) by the belt 24. As the belt 24 transports the paper S, the paper S is moved toward the head unit 40 in the transportation direction. The paper S which has passed through out the printable region is discharged outside the printer by the belt 24. The paper S is stuck to the belt 24 by electrostatic adsorption or vacuum adsorption while it is being transported.

The head unit 40 has a head 41 discharging ink droplets to the paper S. The head 41 forms dots on the paper S by discharging ink droplets to the paper S which is being transported and prints an image on the paper S.

The operation state in the printer 1 is monitored by a detector group 50. The detector group 50 outputs detection results to the controller 60. The controller 60 controls all parts of the printer on the basis of the detection results.

The controller 60 is a control unit for performing control of the printer 1. The controller 60 is connected to an interface portion 61 inside the printer 1 and is made to be able to communicate with the computer 110. The controller 60 has an arithmetic processing function used for controlling the entire printer. The controller includes a memory storing for programs and data therein. The controller controls all parts of the printer according to the program stored in the memory.

The drive signal generating circuit 70 is a circuit for generating a drive signal which is applied to piezoelectric elements in the head in order to discharge ink droplets from the nozzles. The drive signal generating circuit 70 outputs the drive signal to the head unit 40 on the basis of waveform data output from the controller 60.

Method of Adjusting a Mounting Position of Head 41

Adjustment of Inclination of Head 41

Figure 3:
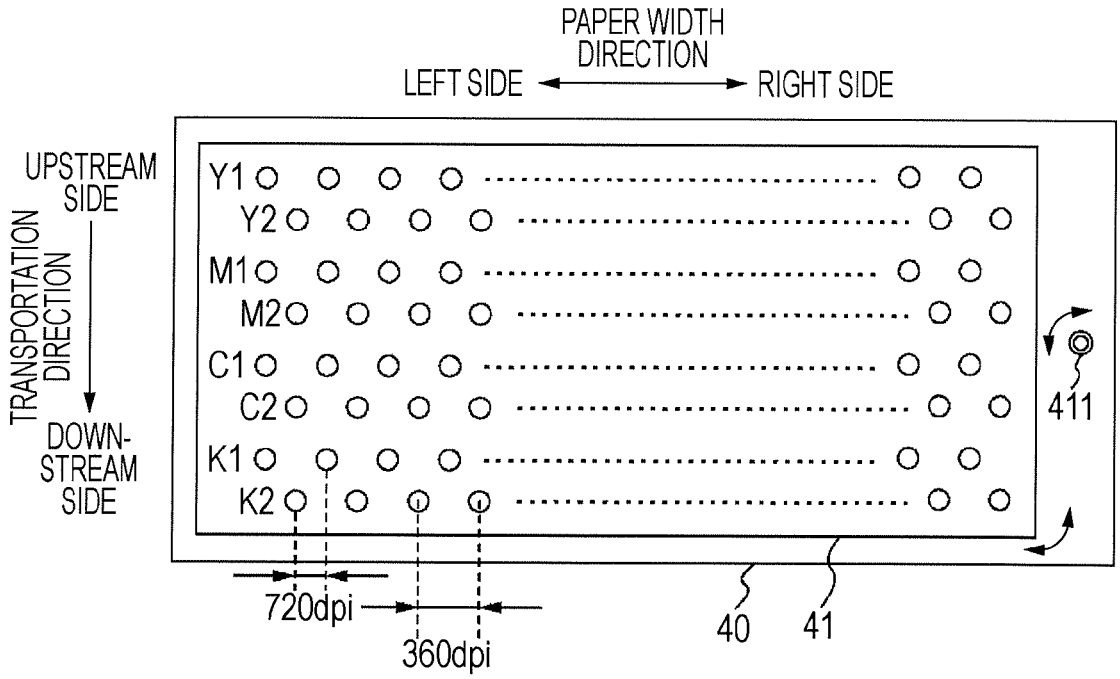
FIG. 3 is a view showing the placement of a head in a head unit according to a first example.

FIG. 3 is a view showing the placement of a head 41 of the head unit 40 according to a first example. In the first example, the head unit 40 has the head 41. The figure is a virtual view of the printer when the head 41 (nozzles) is viewed from the topside of the printer 1. The head 41 has eight nozzle columns, each having nozzles lined up in an intersecting direction with respect to the transportation direction (hereinafter, referred to as the paper width direction). The printer 1 can discharge 4 colors of ink Y, M, C, and K. The same color of ink is discharged from two nozzle columns. Yellow nozzle columns Y1 and Y2, magenta nozzle columns M1 and M2, cyan nozzle columns C1 and C2, and black nozzle columns K1 and K2 are arranged in this order from the upstream side of the transportation direction. One nozzle column has N nozzles and the nozzles are lined up in the paper width direction at intervals of 360 dpi. The nozzle columns discharging the same color of ink (for example, Y1 and Y2) are misaligned with each other by the amount of 720 dpi in the paper width direction. Accordingly, on the underside surface of the head unit 40, the nozzles discharging four colors of ink Y, M, C, and K are arranged in the paper width direction (corresponding to a predetermined direction) at intervals (nozzle pitches) of 720 dpi.

The head 41 is provided with an angle adjusting dial 411 which can adjust the angle of the head 41 (nozzle column) with respect to the head unit 40. Therefore, it is possible to adjust the angle of the nozzle column direction of the head 41 with respect to the transportation direction of the paper S by rotating the angle adjusting dial 411.

Figure 4:
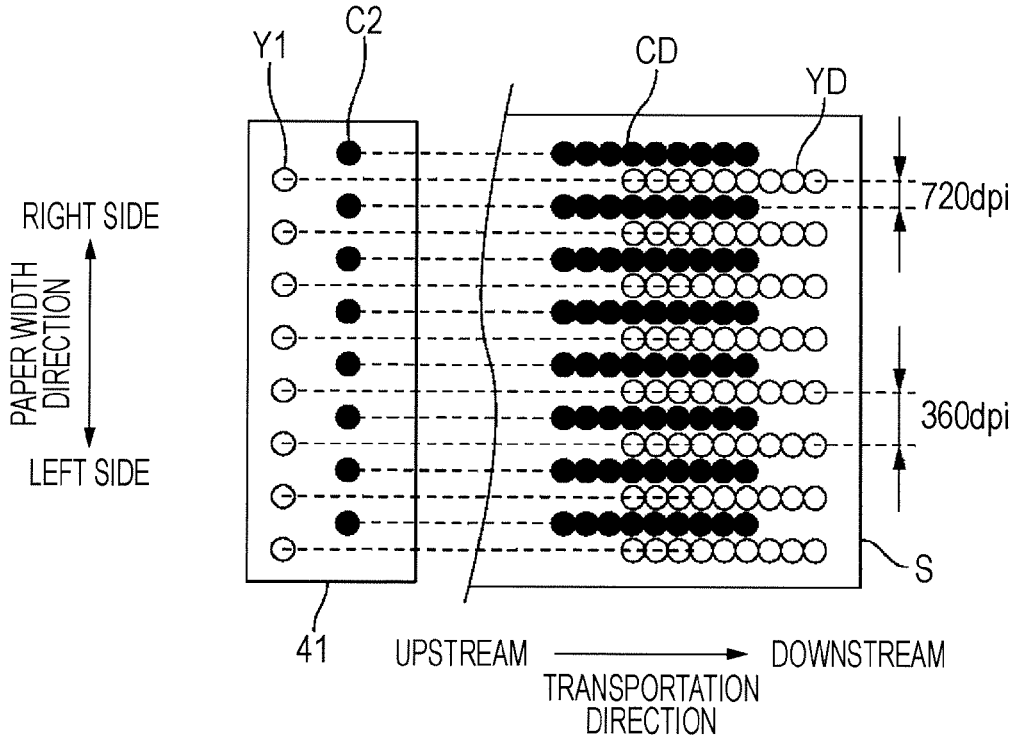
FIG. 4 is a view showing a first exemplary correction pattern.

FIG. 4 is a view showing a correction pattern formed in the first exemplary head unit 40. The figure shows the correction pattern formed in the case in which the nozzle column direction of the head 41 and the paper width direction are parallel to each other. Further, for example, each nozzle column has eight nozzles. The correction pattern of this embodiment is provided for two nozzle columns out of the eight nozzle columns. Further, the correction pattern is formed by two nozzle columns misaligned with each other in the paper width direction. Here, the nozzle columns which form the correction pattern are the yellow nozzle column Y1 (corresponding to a first nozzle column) at the upstream side in the transportation direction of two yellow nozzle columns and the cyan nozzle column C2 (a second nozzle column) at the downstream side in the transportation direction of two cyan nozzle columns. However, the nozzle columns forming the correction pattern are not limited thereto.

The correction pattern is formed by the configuration in which ink is discharged from two nozzle columns Y1 and C2 while the paper S is being transported in the transportation direction. Accordingly, as shown in the figure, the correction pattern is constituted as dot columns formed in the transportation direction. Here, the correction pattern is formed by making all of the nozzles belonging to two nozzle columns Y1 and C2 discharge ink. To this end, the paper-width-direction distance between dot columns (cyan dot columns CD, ●) formed by the cyan nozzle column C2 and the paper-width-direction distance between dot columns (yellow dot columns YD, ○) formed by the yellow nozzle column Y1 is 360 dpi, and the paper-width-direction distance between the cyan dot column CD (corresponding to the first pattern) and the yellow dot column YD (corresponding to the second pattern) is 720 dpi.

Further, ink is discharged from the yellow nozzle columns Y and then ink is discharged from the cyan nozzle columns C toward the paper S which is being transported in the transportation direction. As a result, as shown in the figure, the yellow dot columns YD are formed on the downstream side of the cyan dot column CD in the transportation direction. Further, the downstream portion of the cyan dot columns CD and the upstream portion of the yellow dot columns YD overlap each other. On the other hand, as for the correction pattern, the cyan dot columns CD and the yellow dot columns YD are formed in an interdigitating manner. With this structure, in the result of the printed correction pattern, it is possible to determine whether plural dot columns arranged in the paper width direction are formed by the yellow nozzle column Y1 or by the cyan nozzle column C2. At this time, the positions of the dots of the cyan dot columns CD in the transportation direction and the positions of the dots of the yellow dot columns YD in the transportation direction are considered to be the same.

Figure 5A:
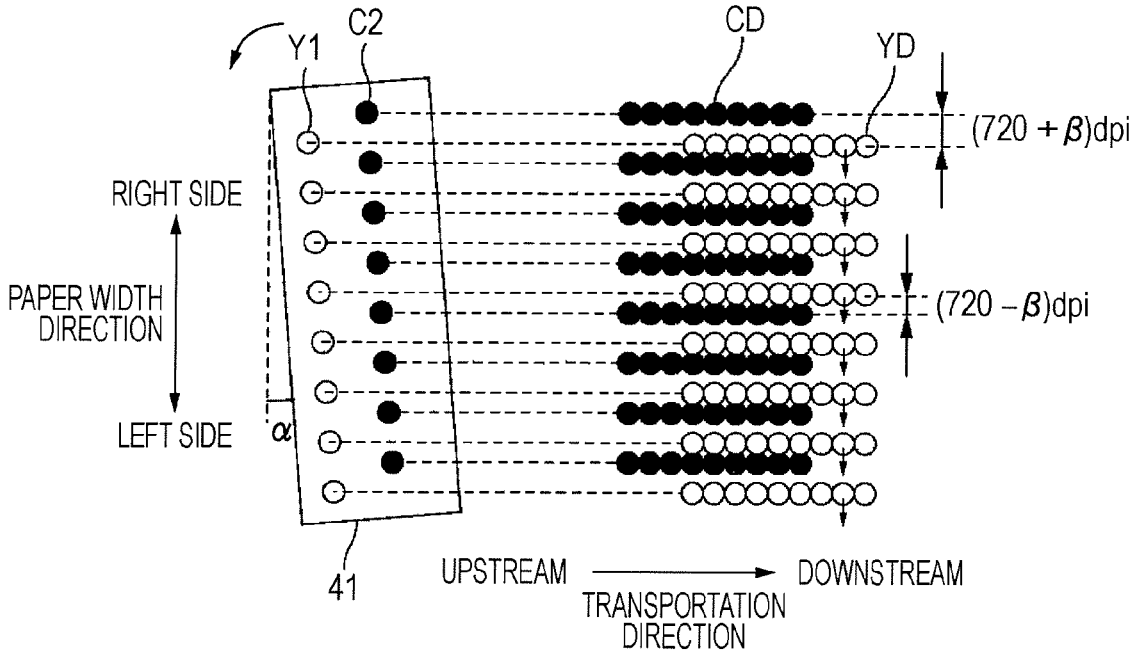
FIG. 5A is a view showing a correction pattern formed in the case in which a head is inclined in a counterclockwise direction and FIG. 5B is a view showing a correction pattern formed in the case in which a head is inclined in a clockwise direction.

FIG. 5A is a view showing the correction pattern formed in the case in which the nozzle columns of the head 41 are inclined in the counterclockwise direction with respect to the paper width direction. In the case in which the nozzle columns are inclined in the counterclockwise direction with respect to the paper width direction at an angle of α, the cyan dot columns CD and the yellow dot columns YD are not arranged at the uniform intervals in the paper width direction. This is because the cyan nozzle columns C2 and the yellow nozzle columns Y1 are spaced apart from each other in the intersecting direction with respect to the nozzle column direction, so that, as for the cyan nozzle column C2 and the yellow nozzle column Y1, the shift amounts of dot formation positions are different in the case in which the head 41 (nozzle column) is inclined and in the case in which the head 41 (nozzle column) is not inclined.

In the case in which the head 41 (nozzle column) is inclined in the counterclockwise direction with respect to the paper width direction, the yellow dot column YD, which is formed between two cyan dot columns CD arranged in the paper width direction, is formed closer to the left side cyan dot column CD. Accordingly, the distance ((720+β) dpi) between the center of the cyan dot column CD positioned on the right side in the paper width direction and the center of the yellow dot column YD positioned on the left side in the paper width direction becomes larger than the nozzle pitch (720 dpi). On the other hand, the distance ((720−β) dpi) between the center of the cyan dot column CD positioned on the left side in the paper width direction and the center of the yellow dot column YD positioned on the right side in the paper width direction is smaller than the nozzle pitch (720 dpi).

Figure 5B:
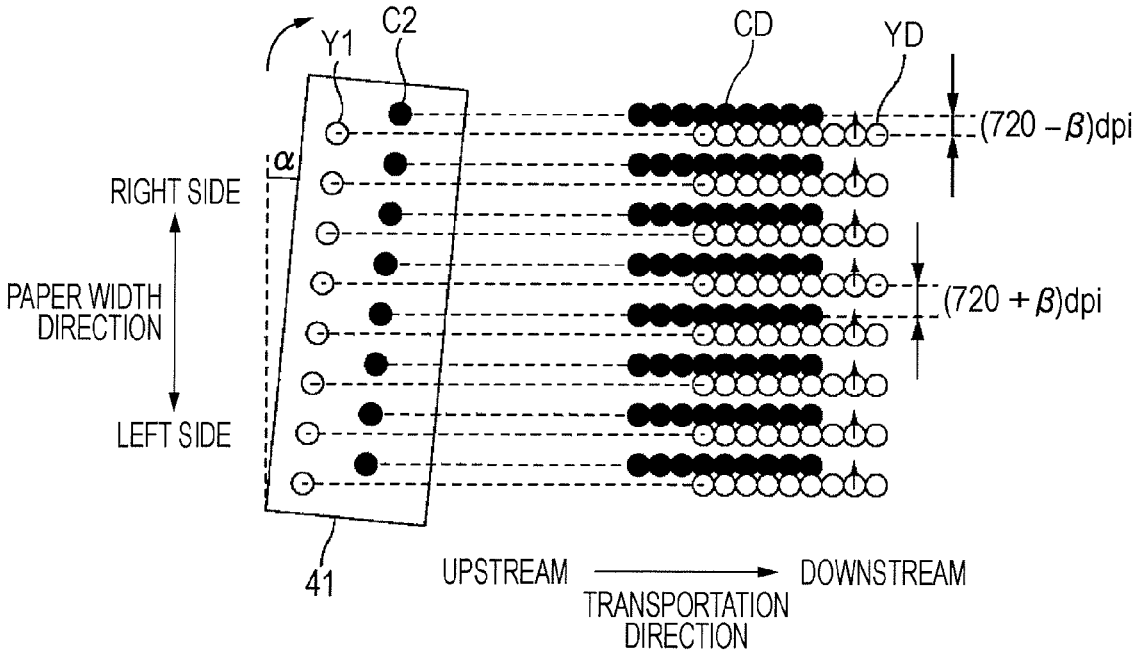

FIG. 5B is a view showing the correction pattern formed in the case in which the nozzle column direction of the head 41 is inclined with respect to the transportation direction in the clockwise direction. In the case in which the head 41 (nozzle column) is inclined with respect to the paper width direction in the clockwise direction, the yellow dot column YD, which is formed between two cyan dot columns CD arranged in the paper width direction, is formed closer to the right side cyan dot column CD. Accordingly, the distance ((720−β) dpi) between the center of the cyan dot column CD positioned on the right side in the paper width direction and the center of the yellow dot column YD positioned on the left side in the paper width direction is smaller than the nozzle pitch (720 dpi). On the other hand, the distance ((720+β) dpi) between the center of the cyan dot column CD positioned on the right side in the paper width direction and the center of the yellow dot column YD positioned on the right side in the paper width direction is larger than the nozzle pitch (720 dpi).

In this manner, it is possible to detect the inclination of the nozzle column direction of the head 41 with respect to the paper width direction by forming the correction pattern shown in FIG. 4 by two nozzle columns of the head 41. In more detail, as shown in FIGS. 5A and 5B, it is possible to determine the inclination direction of the head 41 (nozzle column) by the relative positional relationship between the cyan dot column CD and the yellow dot column YD in the paper width direction. Therefore, it is possible to detect the inclination amount of the head 41 on the basis of "difference β" between the distance between the cyan dot column CD and the yellow dot column YD and the nozzle pitch 720 dpi. The larger the "difference β," the larger the inclination amount of the head 41. Further, it is possible to adjust the inclination of the head 41 (nozzle column) on the basis of the results of the correction pattern using the angle adjusting dial 411 by obtaining the relationship between the inclination amount of the head 41 and the "difference β."

Adjustment of Positional Misalignment of Plural Heads 42 and 43.

Figure 6:
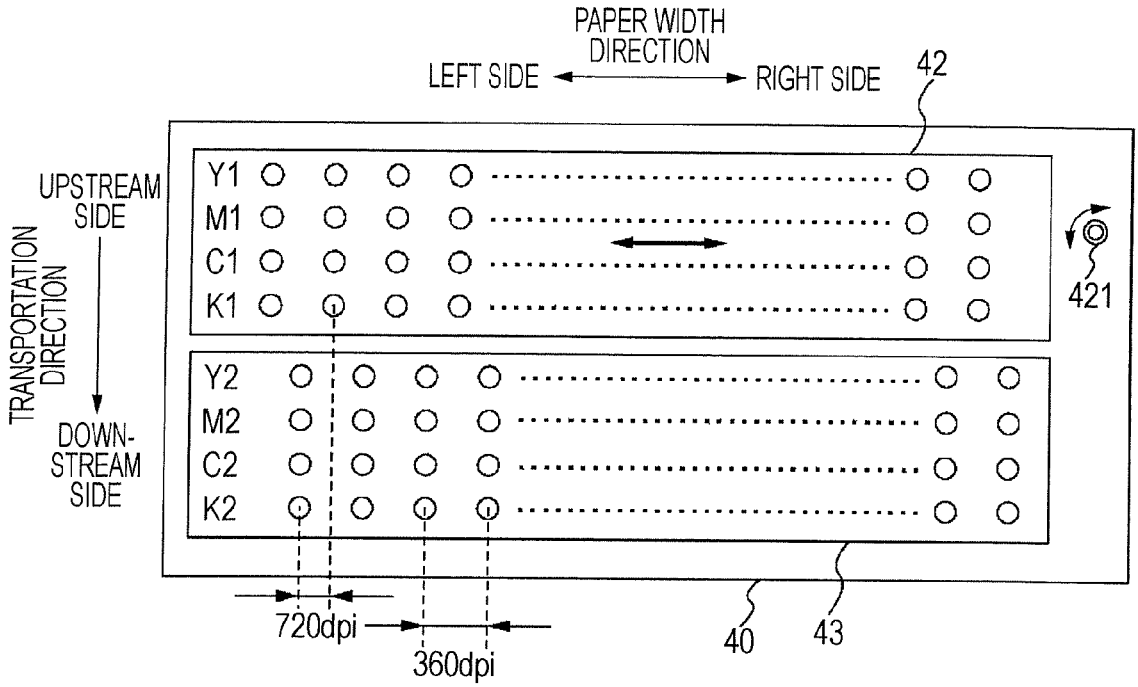
FIG. 6 is a view showing placement of a head according to a second example.

FIG. 6 is a view showing placement of heads 42 and 43 of a head unit 40 according to a second example. In the second example, the head unit 40 has a first head 42 and a second head 43. The first head 42 is positioned on an upstream side of the second head 43 in the transportation direction. Each of the first head 42 and the second head 43 has four nozzle columns Y, M, C, and K discharging four colors of ink. One nozzle column has N nozzles and the nozzles are arranged in the paper width direction at intervals of 360 dpi. The nozzle columns Y1, M1, C1, and K1 of the first head 42 are spaced away from the nozzle columns Y2, M2, C2, and K2 of the second head 43 to the left side in the paper width direction by the amount of 720 dpi. Accordingly, on the underside surface of the head unit 40, the nozzles discharging four colors of ink Y, M, C, and K are arranged at intervals of 720 dpi (nozzle pitch) in the paper width direction.

The first head 42 is provided with a transition adjusting dial 421 which can change the direction of the nozzle columns of the first head 42 in the head unit 40. Therefore, it is possible to move and adjust the positions of the nozzle columns of the first head 42 with respect to the paper width direction by rotating the transition adjusting dial 421.

Figure 7:
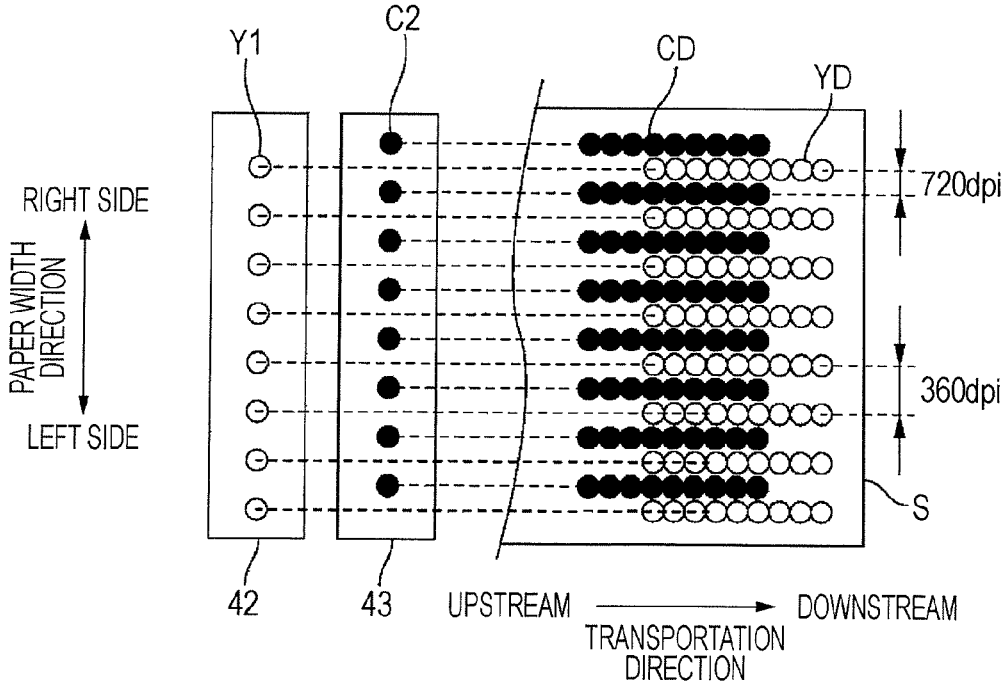
FIG. 7 is a view showing a second exemplary correction pattern.

FIG. 7 is a view showing the correction pattern formed in the second exemplary head unit 40. The figure shows the correction pattern formed in the case in which the nozzle columns of the first head 42 are spaced from the nozzle columns of the second head 43 to the left side in the paper width direction by the amount of the nozzle pitch (720 dpi). The correction pattern is formed by one nozzle column out of the four nozzle columns of the first head 42 and one nozzle column out of the four nozzle columns of the second head 43. That is, two nozzle columns used for forming the correction pattern are nozzle columns spaced with each other in the paper width direction. Here, the nozzle columns used for forming the correction pattern are the yellow nozzle column Y1 (corresponding to the first nozzle column) of the first head 42 and the cyan nozzle column C2 (corresponding to the second nozzle column) of the second head 43. The nozzle columns used for forming the correction pattern are not limited thereto.

In similar with the above-described correction pattern (FIG. 4), the correction pattern is formed by the structure in which a dot column (hereinafter, cyan dot column CD, ●, corresponding to a second pattern) formed by the cyan nozzle column C2 and a dot column (hereinafter, a yellow dot column YD, ○, corresponding to a first pattern) formed by the yellow nozzle column Y1 are alternately arranged in the paper width direction at intervals of 720 dpi. The cyan dot column CD is positioned on an upstream side of the yellow dot column YD in the transportation direction, and a downstream portion of the cyan dot column CD and an upstream portion of the yellow dot column YD overlap each other.

Figure 8A:
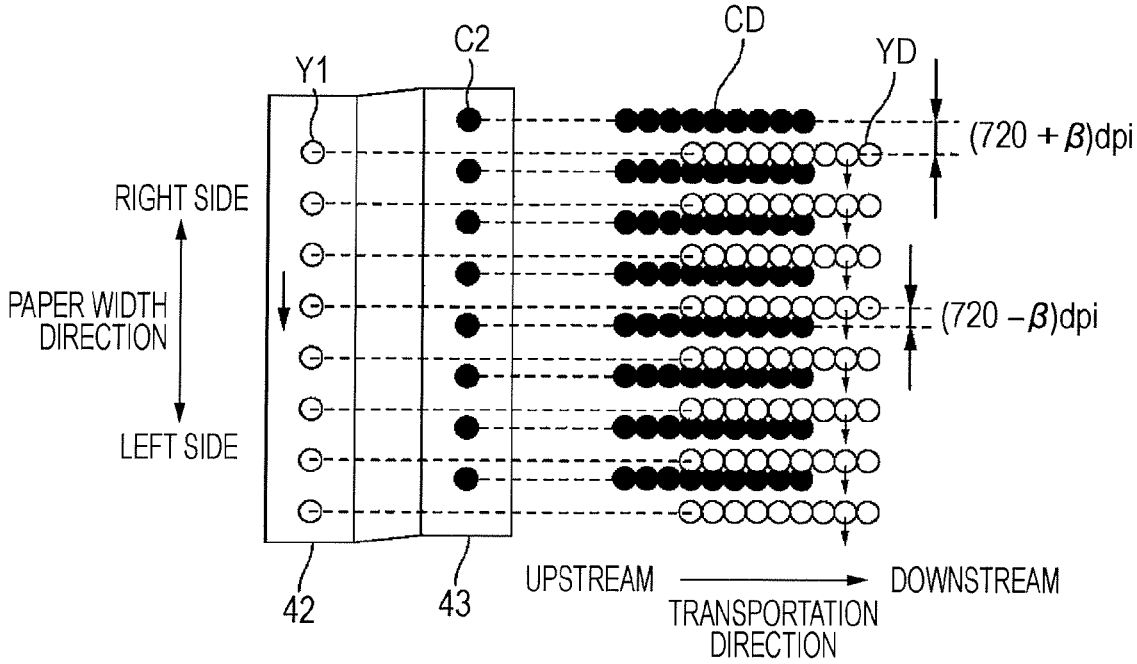
FIG. 8A is a view showing a correction pattern formed when a first head is spaced with and shifted from the second head to the left side in a paper width direction.

FIG. 8A is a view showing the correction pattern formed in the case in which the first head 42 is misaligned with the second head 43 to the left side in the paper width direction. In this manner, in the case in which the first head 42 and the second head 43 are in misalignment relationship in the paper width direction, the distance between the nozzle column of the first head 42 and the nozzle column of the second head 43 is not equal to the nozzle pitch (720 dpi). Accordingly, in the correction pattern result, the cyan dot column CD and the yellow dot column YD are not arranged at the same interval in the paper width direction.

When the first head 42 is shifted away from the second head 43 to the left side in the paper width direction, the yellow dot column YD, which is formed between two cyan dot columns CD arranged in the paper width direction, is formed closer to the cyan dot column CD on the left side. Accordingly, the distance ((720+β) dpi) between the cyan dot column CD positioned on the right side in the paper width direction and the yellow dot column YD positioned on the left side in the paper width direction is larger than the nozzle pitch (720 dpi). On the other hand, the distance (((720−β) dpi) between the cyan dot column CD positioned on the left side in the paper width direction and the yellow dot column YD positioned on the right side in the paper width direction is smaller than the nozzle pitch (720 dpi).

Figure 8B:
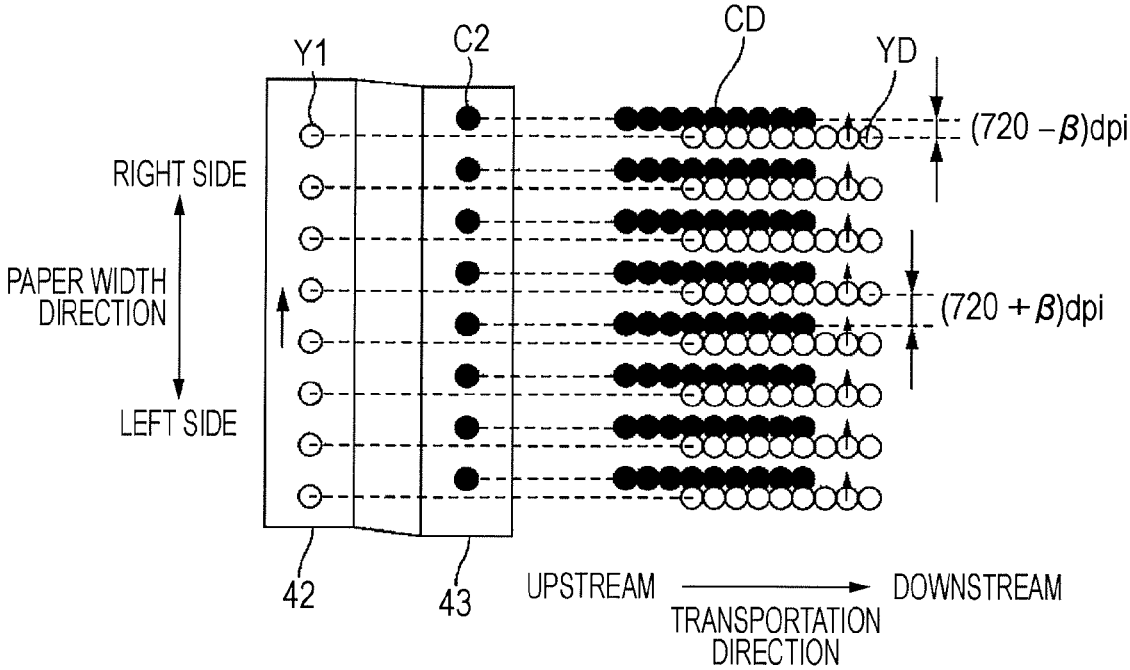
FIG. 8B is a view showing a correction pattern formed when a first head is spaced with and shifted from the second head to the right side in the paper width direction.

FIG. 8B is a view showing the correction pattern formed in the case in which the first head 42 is shifted from the second head 43 to the right side in the paper width direction. At this time, the yellow dot column YD, which is formed between two cyan dot columns CD arranged in the paper width direction, is formed closer to the cyan dot column CD on the right side. For this reason, the distance ((720−β) dpi) between the cyan dot column CD positioned on the right side in the paper width direction and the yellow dot column YD positioned on the left side in the paper width direction is smaller than the nozzle pitch (720 dpi). On the other hand, the distance ((720+β) dpi) between the cyan dot column CD positioned on the left side in the paper width direction and the yellow dot column YD positioned on the right side in the paper width direction is larger than the nozzle pitch (720 dpi).

In this manner, it is possible to detect misalignments between the first head 42 and the second head 43 in the paper width direction by the forming of the correction pattern shown in FIG. 6 by the nozzle column of the first head 42 and the nozzle column of the second head 43. In more detail, as shown in FIGS. 8A and 8B, it is possible to determine the misalignment direction of the first head 42 with respect to the second heads 43 in the paper width direction by the relative positional relationship between the cyan dot column CD and the yellow dot column YD in the paper width direction. Thus, the "difference β" between the distance between the cyan dot column CD and the yellow dot column YD and the nozzle pitch (720 dpi) corresponding to the positional misalignment amount of the first head 42 with respect to the second head 43 in the paper width direction. The positional misalignment amount β of the first head 42 with respect to the second head 43 in the paper width direction can be adjusted by the transition adjusting dial 421 which moves the first head 42 in the paper width direction. Further, here, although the first head 42 is misaligned with the second head 43 in the paper width direction, but such misalignment is not limited thereto. The misalignment amount of the relative positional relationship of the first and second heads 42 and 43 is detected by the correction pattern.

In conclusion, the correction pattern (FIG. 4) used for adjusting the inclination of the head 41 in the paper width direction and the correction pattern (FIG. 6) used for adjusting the misalignment between two heads, the first head 42 and the second head 43, which are arranged in the transportation direction, in the paper width direction have the same shape. Therefore, it is possible to detect the inclination of the head 41 and the misalignment between the first head 42 and the second head 43 in the paper width direction on the basis of the relative positional relationship between the cyan dot column CD and the yellow dot column YD, which constitute the correction pattern, in the paper width direction.

Such a detection method for the inclination of the head and the positional misalignment of a plurality of heads may be performed when attaching the head unit 40 to the printer 1 or when attaching a plurality of head units 42 and 43 to the head unit 40 in the manufacturing processing of the printer 1, or be performed when a user attaches a new head unit 40 to the printer 1 as the old head unit 40 has broken down during the use of the printer 1. If a state in which the nozzle column of the head 41 is inclined with respect to the paper width direction is detected, the head 41 is adjusted by the angle adjusting dial 411 such that the nozzle column direction of the head 41 is parallel with the paper width direction. If the positional relationship in which the first head 42 and the second head 43 is misaligned in the paper width direction is detected, the position of the first head 42 in the paper width direction with respect to the second head 43 is adjusted by the transition adjusting dial 421. With such an operation, it is possible to suppress deterioration of image quality of a print image using four colors of nozzle columns Y, M, C, and K of the head unit 40 because the dots are formed at positions arranged at the same interval in the paper width direction.

Example of Formation of Test Pattern

Figure 9A:
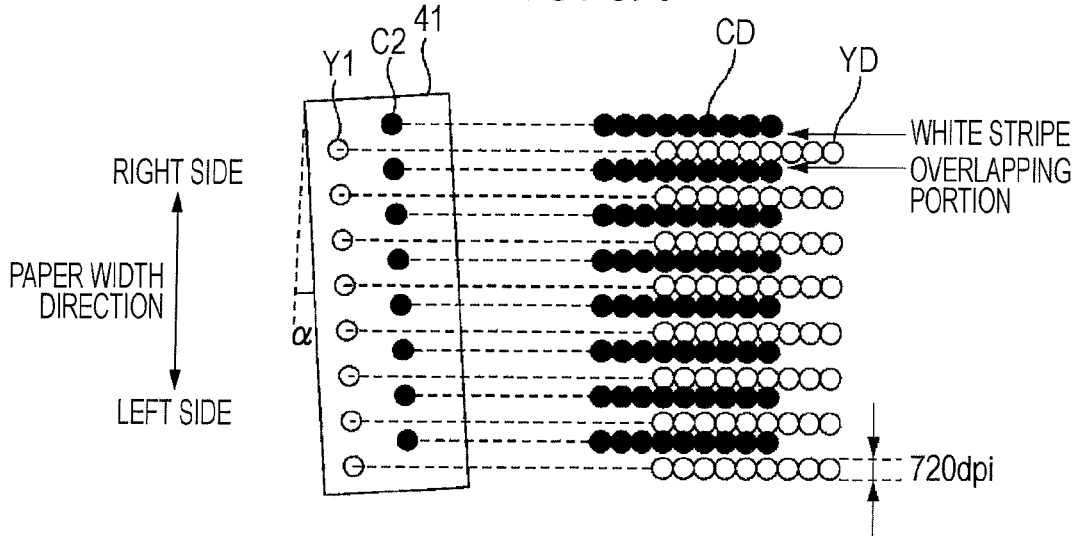
FIGS. 9A to 9C are views showing correction patterns when dot sizes are different.
Figure 9B:
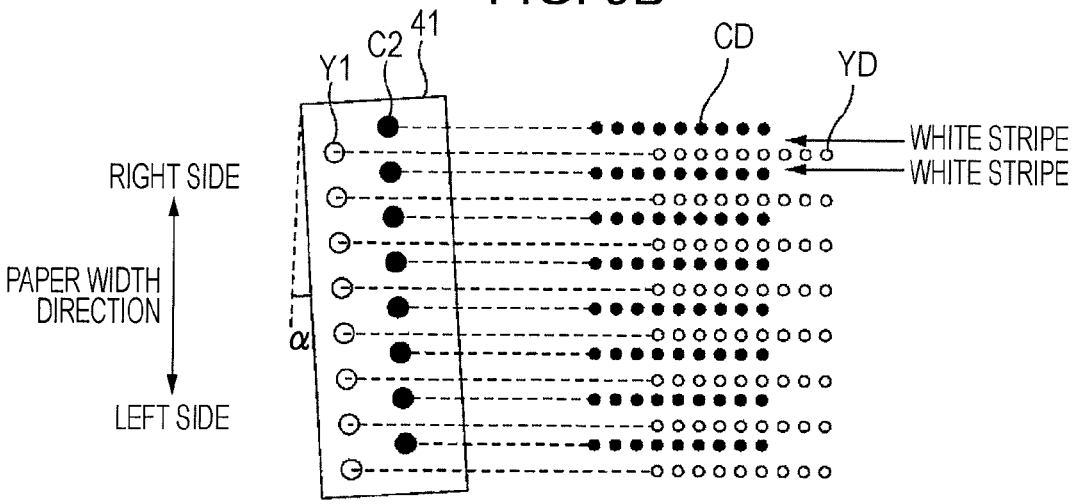
Figure 9C:
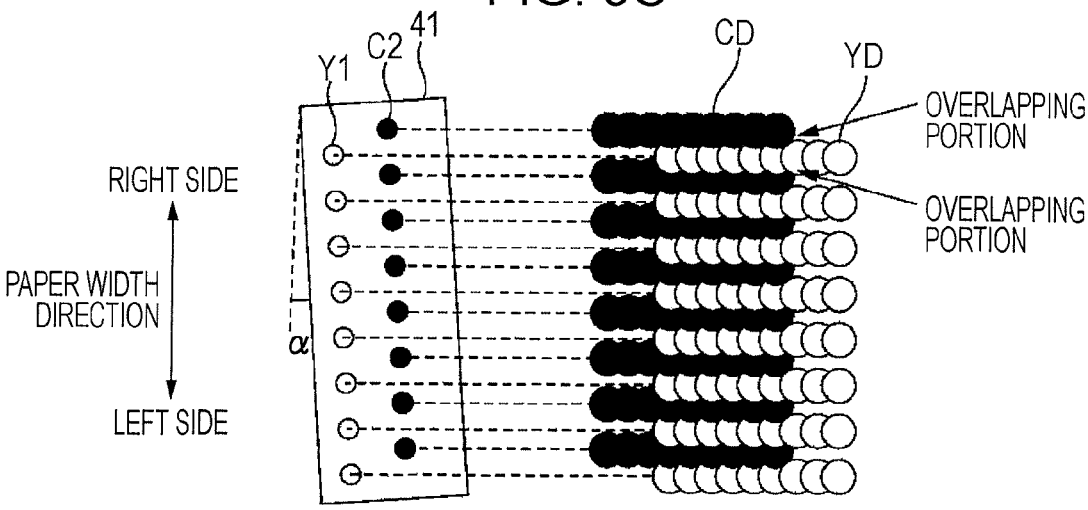

FIGS. 9A to 9C are views showing correction patterns with different dot sizes. Hereinafter, an example of the correction pattern (FIG. 4) formed for detecting the inclination of the head 41 (nozzle column) will be explained. The figure shows the correction patterns formed in the case in which the head 41 is inclined with respect to the paper width direction in the counterclockwise direction. The inclination amounts of the head 41 in FIG. 9A to 9C are equal to each other (angle α).

The diameter of the dots constituting the correction pattern of FIG. 9A is "nozzle pitch (720 dpi)." For such a reason, when the head 41 is not inclined (not shown), the dots of the cyan dot column CD and the dots of the yellow dot column YD come in contact with each other at a single point. If the head 41 is inclined with respect to the paper width direction (for example, angle α) at a small angle, as shown in FIG. 9A, the cyan dot column CD and the yellow dot column YD overlaps each other at one side in the paper width direction, and at the other side in the paper width direction, a gap is formed between the cyan dot column CD and the yellow dot column YD and therefore a white stripe (paper color) appears. Accordingly, a tester who monitors the results of the correction pattern can determine whether the head 41 is inclined when the "white stripe" appears when viewing the correction pattern overall.

In this manner, if the dots have sizes large as such that the cyan dot column CD and the yellow dot column YD come in contact with each other, the "white stripe" appears in the correction pattern result by the slightest inclination of the head 41, and therefore the inclination of the head 41 can be precisely detected by the eyes of the tester. If the inclination of the head 41 (misalignment in the paper width direction) can be visually detected, it is possible to reduce processing time. Further, it is possible to detect the inclination and misalignment of the head 41 even in the cases in which a high resolution scanner or a microscope is not used. Further, it is easy to detect the inclination of the head 41 by recognizing whether or not a white stripe appears in the correction pattern result, and users who are not familiar with detection processing also can perform the detection of the inclination.

On the other hand, a diameter of the dots constituting the correction pattern of FIG. 9B is smaller than the "nozzle pitch (720 dpi)." Accordingly, even when the head 41 is not inclined (not shown), the gap is formed between the cyan dot column CD and the yellow dot column YD, therefore the white color of the paper appears. For such a reason, even if the head 41 is inclined (angle α) at a small angle, as shown in FIG. 9B, there is no such phenomenon in which the cyan dot column CD and the yellow dot column YD overlap each other. That is, the white tripe appears between the cyan dot column CD positioned on the right side in the paper width direction and the yellow dot column YD at the left side in the paper width direction, and also the white stripe appears between the cyan dot column CD positioned on the left side in the paper width direction and the yellow dot column YD positioned on the right side in the paper width direction. If the head 41 is inclined in the counterclockwise direction, since the yellow dot column YD, which is positioned between two cyan dot columns CD arranged in the paper width direction, is formed closer to the left side, the lengths of the white stripes, in the paper width direction, formed at the left and right sides of the yellow dot column YD are different. However, in the practical test pattern, the gap (white stripe) between the yellow dot column YD and the cyan dot column CD is very small. Accordingly, there is a possibility that the tester of the correction pattern result misjudges such that the cyan dot column CD and the yellow dot column YD are arranged at uniform intervals. In particular, such misjudgment may be easily made when the detection is visually performed.

A diameter of dots constituting the correction pattern of FIG. 9C is larger than the "nozzle pitch (720 dpi)." Accordingly, even when the head 41 is not inclined (not shown), the cyan dot column CD and the yellow dot column YD overlap each other. Further, even if the head 41 is inclined (angle $\alpha$) at a small angle, as shown in FIG. 9C, the white stripe does not appear between the cyan dot column CD and the yellow dot column YD, the cyan dot column CD positioned on the right side in the paper width direction and the yellow dot column YD positioned on the left side in the paper width direction overlap, and the cyan dot column CD positioned on the left side in the paper width direction and the yellow dot column YD at the right side in the paper width direction overlap each other. If the head 41 is inclined in the counterclockwise direction, since the yellow dot column YD, which is positioned between two cyan dot columns CD arranged in lines in the paper width direction, is formed closer to the left side, the yellow dot column YD overlap significantly more on the left side cyan dot column CD than on the right side cyan dot column CD. However, practically, it is difficult to detect the inclination of the head 41 by comparing the sizes of overlapped portions of the cyan dot column CD and the yellow dot column YD because the ink on the dots spreads when the dots are formed in an overlapped state. Further, in the case in which the same color of liquid is discharged from two nozzle columns used for forming the correction pattern, it is difficult to know the size of the overlapped portion of the dot columns formed by the two nozzle columns.

That is, according to the size of the dots constituting the correction pattern, there is a possibility that it is not possible to precisely detect the inclination of the head 41 (or positional misalignment of the plural heads 42 and 43 in the paper width direction). When the head 41 is not inclined, if the cyan dot column CD and the yellow dot column YD are in contact with each other at a single point, it is possible to easily visually detect the inclination of the head 41 with a high degree of precision. In other words, as for the cyan dot column CD positioned on one side in the paper width direction and the yellow dot column YD positioned on the other side in the paper width direction, it is desirable that the distance between the outer contour (end) of the cyan dot column CD at the other side and the outer contour (end) of the yellow dot column YD at one side is zero (0).

Figure 10A:
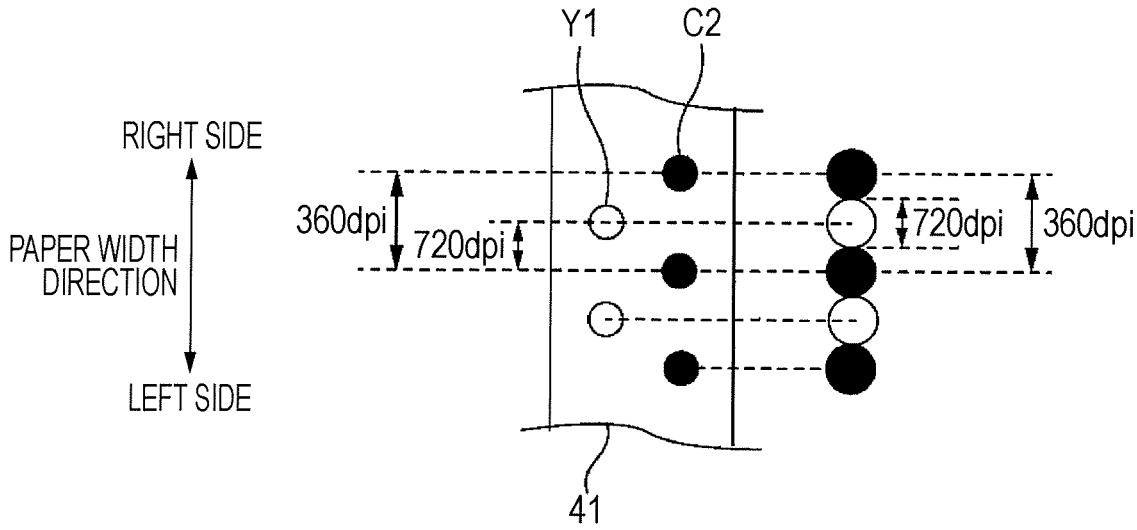
FIG. 10A is a view showing dot size when dot columns contact each other at a single point and FIG. 10B is a view showing changes of distance between contours of dots.

FIG. 10A is a view showing the size of a dot when the cyan dot column CD and the yellow dot column YD are in contact with each other at a single point. In this embodiment, since the nozzle pitch of one nozzle column in the paper width direction is set to "360 dpi," the distance between the centers of two cyan dots ● arranged in the paper width direction is "360 dpi." Further, in the case in which the cyan dot (●) and the yellow dot (○) are made to be in contact with each other, and the diameters of the cyan dot (●) and the yellow dot (○) are set to be equal, it is desirable that the diameter of each of the cyan dot and the yellow dot is "720 dpi." That is, the diameter of the dots is set such that "nozzle pitch=resolution in the paper width direction=720 dpi." In such a case, the distance between the left side outer contour (end) of the cyan dot (●) at the right side in the paper width direction and the right side outer contour (end) of the cyan dot (●) at the left side in the paper width direction is "720 dpi," and the cyan dot (●) and the yellow dot (○) are in contact with each other at a single point. The diameter "720 dpi" of the dot when the cyan dots and the yellow dots are in contact with each other at a single point is considered as the "theoretical diameter."

Here, one correction pattern is formed such that the diameter of the dots constituting the correction pattern is the theoretical diameter (720 dpi). With such a correction pattern, in the case in which the cyan dot column CD and the yellow dot column YD are formed as designed, it is possible to detect the inclination of the head 41 (or positional misalignment in the paper width direction) with a high degree of precision.

However, in the case of practically printing out the correction pattern, since osmosis and absorption of ink are different according to the kinds of media and there is an error in the ink discharge amount due to characteristic differences in the heads 41 or the nozzles, there is a possibility that it is not possible to form the dots with the designed size. As a result, with only one correction pattern, there is a possibility that it is not possible to precisely detect the inclination of the head 41 (or positional misalignment in the paper width direction) because the size of the dots is too small as shown in FIG. 9B or the size of the dots is too large as shown in FIG. 9C.

Accordingly, in this embodiment, a plurality of correction patterns is formed by changing the gap size between the other side outer contour (end) of the cyan dot column CD positioned on one side in an intersecting direction with respect to the transportation direction and the one side outer contour (end) of the yellow dot column YD positioned on the other side in the intersecting direction with respect to the transportation direction. In this manner, the tester selects the optimum correction pattern from a plurality of correction patterns and detects the inclination of the head 41 or the positional misalignment of the plural heads 42 and 43 in the paper width direction on the basis of the selected correction pattern. The optimum correction pattern is a correction pattern as shown in FIG. 9A where the diameter of the dots constituting the correction pattern have a value which is equal to or approximate to the theoretical diameter=720 dpi. Hereinafter, for description's sake, the plurality of correction patterns in which the gaps between the outer contours (end) of the cyan dot column CD and the outer contours (end) of the yellow dot column YD have different values are all called "test pattern." In this embodiment, the controller 60 (corresponding to the control portion) in the printer 1 forms the test pattern composed of the plurality of correction patterns on the basis of print data produced by a printer driver of the computer 110.

For example, the test pattern having three correction patterns shown in FIGS. 9A to 9C is formed to detect the inclination of the head 41 by using the printer 1. In this case, the tester can detect the inclination of the head 41 on the basis of the results of the correction pattern (FIG. 9A), by which it is the easiest to detect the inclination of the head 41 among the three correction patterns.

Figure 10B:
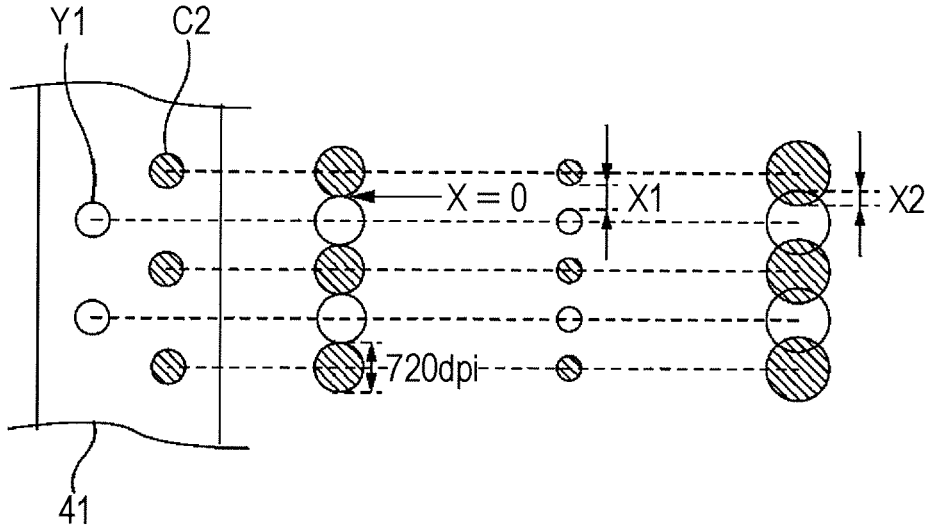

FIG. 10B is a view in which the gaps X between the outer contour of the cyan dot and the outer contour of the yellow dot have various values. In the figure, for description's sake, the hatched dots are cyan dots and the white dots are yellow dots. If the diameter of the cyan dots and the yellow dots is the "theoretical diameter=720 dpi," and the cyan dot and the yellow dot are in contact with each other, the gap X between the outer contour of the cyan dot and the outer contour of the yellow dot is "zero (0)." In the case in which the diameter of the cyan dots and yellow dots is smaller than 720 dpi, as shown in the figure, a gap X1 between the outer contour of the cyan dot and the outer contour of the yellow dot is the same as such that the gap where the color of the medium appears. On the other hand, in the case in which the diameter of the cyan dots and yellow dots is lager than 720 dpi, as shown in the figure, the outer contour of the cyan dot is positioned within the yellow dot, and the outer contour of the yellow dot is positioned within the cyan dot. That is, the gap X2 between the outer contour of the cyan dot and the outer contour of the yellow dot is equal to the gap when the cyan dot and the yellow dot overlap each other.

First Exemplary Test Pattern

Figure 11:
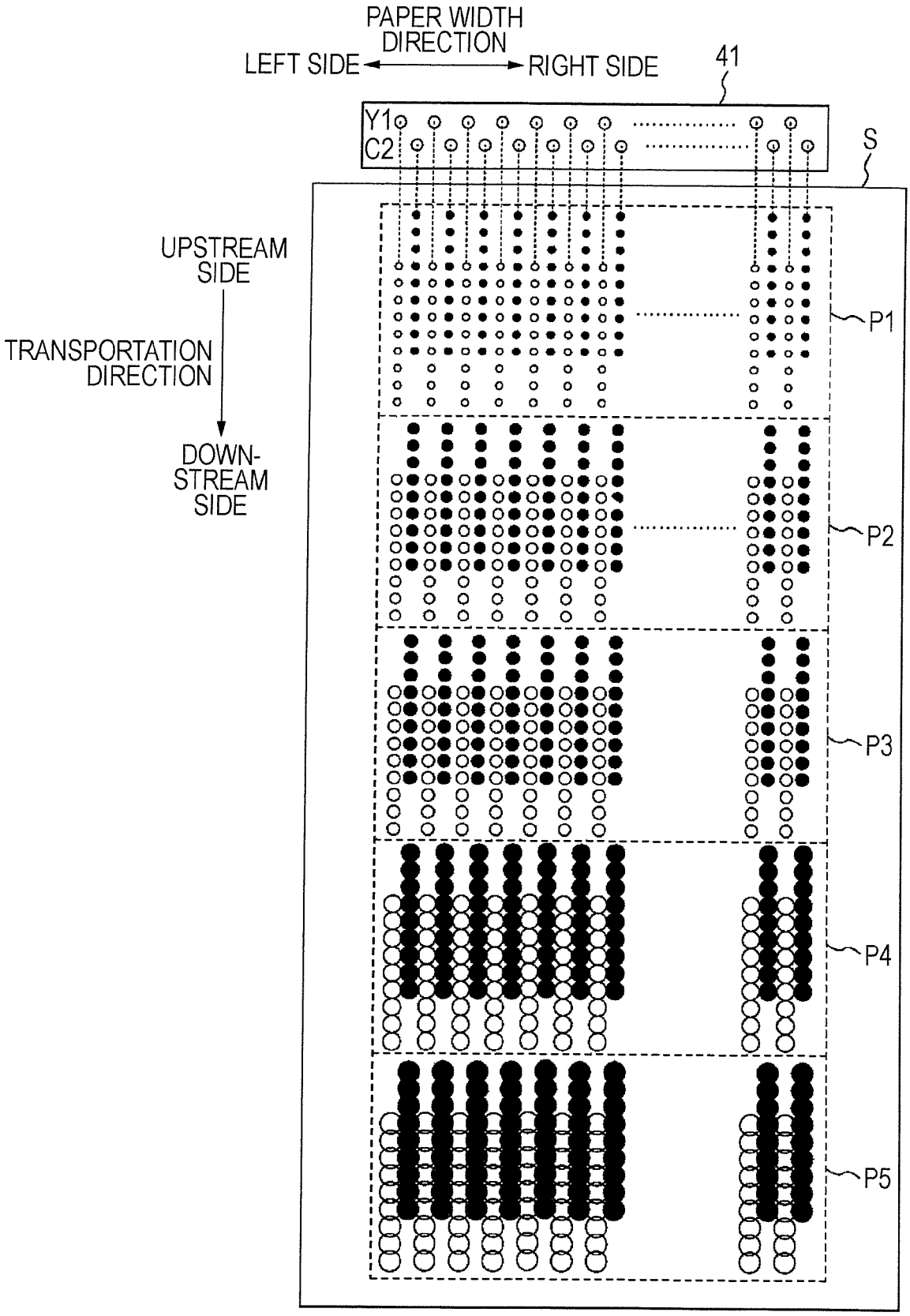
FIG. 11 is a view showing a first exemplary test pattern in the case in which the head is not inclined.

FIG. 11 is a view showing a first exemplary test pattern in the case in which the head 41 is not inclined. In the following description, the correction pattern for detecting the inclination of the head 41 is exemplified. In the first exemplary test pattern, in order to form a plurality of correction patterns in which the distances between the outer contours of the cyan dot columns CD and the outer contours of the yellow dot columns YD are different, the sizes of dots (diameters of dots) constituting the correction patterns are uniformly changed (for example, by 8 μm). In the figure, five kinds of correction patterns P1 to P5 are printed as the test pattern on the paper S. For example, on the basis of the print data for printing the test pattern, the controller 60 in the printer 1 causes the nozzle columns to print a first correction pattern P1 composed of dots having a diameter of 11 μm, a second correction pattern P2 composed of dots having a diameter of 19 μm, a third correction pattern P3 composed of dots having a diameter of 27 μm, a fourth correction pattern P4 composed of dots having a diameter of 35 μm (theoretical diameter≅720 dpi), and a fifth correction pattern P5 composed of dots having a diameter of 43 μm. Here, the correction pattern is formed such that the diameter (theoretical diameter) of the dots is as large as such that the cyan dot column CD and the yellow dot column YD are in contact with each other at a single point. However, the correction pattern may be formed with dots that do not have the theoretical diameter.

In the first exemplary test pattern, the diameter of the dots constituting each of the correction patterns varies by 8 μm. However, since the nozzle columns (Y1, C2) forming each of the correction patterns are the same, the distance "720 dpi" between the center of the cyan dot column and the center of the yellow dot column in the paper width direction is constant regardless of the kind of correction pattern. As a result, the distance between the outer contour of the cyan dot column CD and the outer contour of the yellow dot column YD varies in the correction patterns P1 to P5.

In the test pattern shown in FIG. 11, the diameter of dots (35 μm≅720 dpi) constituting the fourth correction pattern P4 is the "theoretical diameter". The test pattern shown in the figure is formed in the case in which the head 41 is not inclined. Further, the test pattern shown in the figure is a test pattern formed as it is instructed in the print data. Accordingly, in the fourth correction pattern P4, the cyan dot column CD and the yellow dot column are in contact with each other at a single point.

A tester of the test pattern selects the optimum correction pattern on the basis of the test pattern result printed by the printer 1. For example, in the first and second correction patterns P1 and P2, the dot size is small and the gap (white stripe) between the cyan dot column CD and the yellow dot column YD is large. Accordingly, in the first and second correction patterns P1 and P2, even if the head 41 is inclined at a small angle, the cyan dot column CD and the yellow dot column YD do not overlap, so that it can be determined such that it is not possible to precisely detect the inclination of the head 41 by the test patterns. On the other hand, in the fifth correction pattern P5, the dot size is large and an end portion of the cyan dot column CD and an end portion of the yellow dot column YD completely overlap each other. Accordingly, in the fifth correction pattern P5, even if the head 41 is inclined at a small angle, the white stripe does not appear between the cyan dot column CD and the yellow dot column YD, so that it can be determined such that it is not possible to correctly detect the inclination of the head 41 by the test pattern.

The dots constituting the fourth correction pattern P4 are not too small or too big. Accordingly, when the head 41 is inclined at a small angle (not shown), a white stripe appears between the cyan dot column CD and the yellow dot column YD. The tester can determine that the fourth correction pattern P4 is suitable for detecting the inclination of the head 41. In the fourth correction pattern P4 of the figure, the cyan dot column CD and the yellow dot column YD are in contact with each other at a single point, and there is no such phenomenon in which the cyan dot column CD and the yellow dot column YD overlap each other or a white stripe appears between the cyan dot column CD and the yellow dot column YD. Accordingly, it can be determined such that the head 41 is not inclined.

In the case in which the dot size is slightly smaller than the theoretical diameter like the third correction pattern P3, the cyan dot column CD and the yellow dot column YD overlap (contact) each other when the head 41 is inclined at a small angle. Accordingly, the tester can determine that it is easier to detect the inclination of the head 41 by the third correction pattern P3 than by the first and second correction patterns P1 and P2 having a very small dot size or the fifth correction pattern P5 having a very large dot size.

In this manner, the tester selects the correction pattern which it is the easiest to detect the inclination of the head 41 by forming a plurality of correction patterns where the dot size varies in multiple steps. Thus, the tester can detect the inclination of the head 41 on the basis of the results of the selected correction pattern. In FIG. 11, providing that the dots are formed as designed, the fourth correction pattern P4 is considered the most suitable correction pattern to easily detect the inclination of the head 41. However, in the case in which the dot size is formed larger than the designed size, the first and second correction patterns P1 and P2 become the most suitable correction patterns to easily detect the inclination of the head 41. Accordingly, as compared to the case in which only one correction pattern is prepared, and the inclination of the head 41 is detected only on the basis of one result of the correction pattern, it is possible to more precisely detect the inclination of the head 41 (or positional misalignment among a plurality of heads) by using a plurality of correction patterns.

Figure 12:
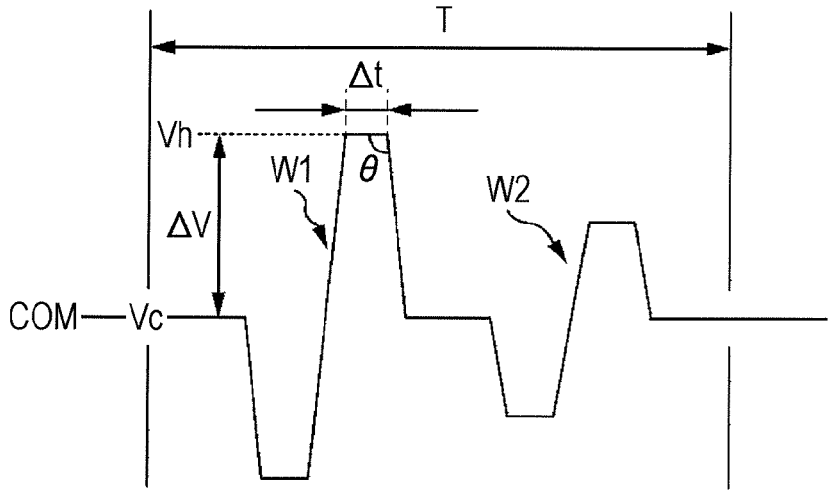
FIG. 12 is a view showing a drive signal for driving nozzles to discharge liquid.

FIG. 12 is a view showing a drive signal COM for driving the nozzles to discharge liquid. In this embodiment, drive elements are deformed by the drive signal COM and pressure chambers filled with ink expand or contracts according to the deformation of the drive elements. With such an operation, the liquid is discharged from the nozzles. For example, the drive signal generating circuit 70 (FIG. 1) generates the drive signal COM having two drive pulses W1 and W2 which are repeated within one period T.

Like the first exemplary test pattern, in the case of forming the correction patterns by changing the dot size (diameter of dots) in a plurality of steps, the dot size, i.e. the liquid discharge amount from the nozzle, can be adjusted by adjusting the drive signal COM. For example, applying only the drive pulse W1 to the drive element can discharge a smaller amount of liquid than applying two drive pulses W1 and W2 to the drive element.

Further, it is also possible to adjust the discharge amount at a subtle degree with the same drive pulse W1 by adjusting a potential difference ΔV in the range from an intermediate potential Vc to the highest potential Vh. If the potential difference ΔV is increased, the pressure chamber is more severely deformed and the discharge amount is increased. Further, a maintaining time Δt in which the highest potential Vh of the drive pulse W is maintained or a gradient θ of the change of the potential when the potential varies from the highest potential Vh to the intermediate potential Vc may be adjusted. That is, it is possible to adjust the liquid discharge amount by changing the form of the drive pulse W.

Figure 13A:
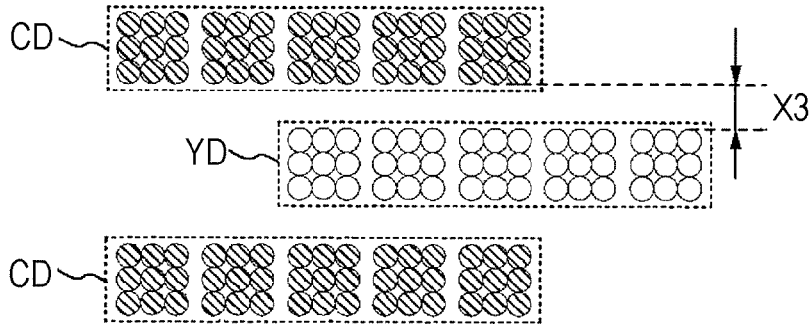
FIG. 13A and FIG. 13B are views showing changes in the distance between the contours of dot columns according to a modification.
Figure 13B:
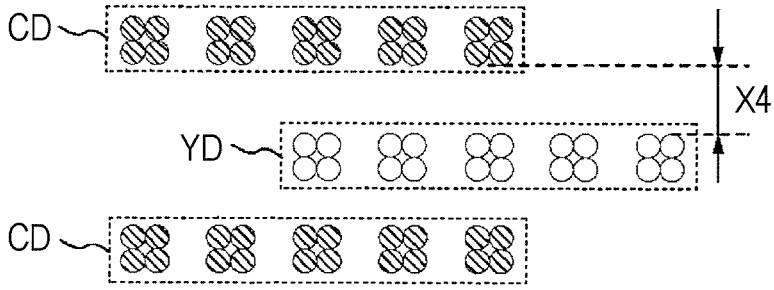

FIG. 13A and FIG. 13B are views showing modifications of the invention which show various sizes of gaps between the outer contour of the cyan dot column CD and the outer contour of the yellow dot column YD. In the test pattern of FIG. 11, the distance (gap size) between the outer contour of the cyan dot column CD and the outer contour of the yellow dot column YD is changed by changing the diameter of the dots (the liquid amount discharged from the nozzle at a time). However, a method of changing the distance is not limited thereto. For example, each of the dots constituting the cyan dot column CD and the yellow dot column YD is formed by combining a plurality of fine dots by using a head in which nozzles are arranged at high density, and the number of fine dots in the head may be changed.

In FIG. 13A, one dot constituting the cyan dot column CD and the yellow dot column YD is formed by nine fine dots. On the other hand, in FIG. 13B, one dot constituting each of the cyan dot column CD and the yellow dot column YD is formed by four fine dots. As a result, the gap X3 between the outer contour of the cyan dot column CD and the outer contour of the yellow dot column YD of FIG. 13A is smaller than the gap X4 between the outer contour of the cyan dot column CD and the outer contour of the yellow dot column YD of FIG. 13B. In this manner, it is possible to form correction patterns in which the gaps between the outer contours of the cyan dot columns CD and the outer contours of the yellow dot columns YD are made to be different by changing the number of fine dots constituting one dot.

Second Exemplary Test Pattern

Figures 14, 15:
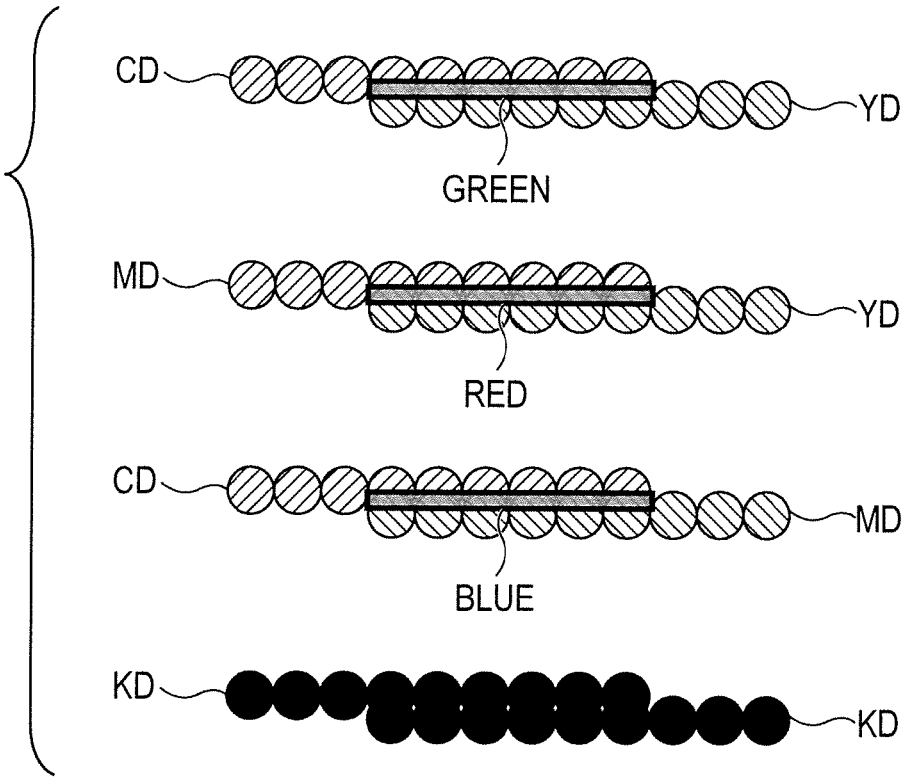
FIG. 14 is a view showing the diameter of dots in a correction pattern constituting a second exemplary test pattern.
FIG. 15 is a view showing ink colors of dot columns constituting a correction pattern.

FIG. 14 is a view showing the diameter of dots in correction patterns constituting a second exemplary test pattern. As described above, with the correction patterns formed such that the cyan dot column CD and the yellow dot column YD contact each other at a single point, it is possible to precisely detect the inclination of the head 41 (or positional misalignment of a plurality of heads). Accordingly, it is desirable that the diameter of dots constituting the cyan dot column CD and the yellow dot column YD is the "theoretical diameter, 35 μm (resolution in the paper width direction, nozzle pitch)." In the first example, the dot sizes in the plurality of correction patterns varied by a uniform amount. However, in the second example, a larger number of correction patterns are formed with dot sizes which are approximate to the theoretical diameter. That is, a certain correction pattern is formed with the dot size (theoretical diameter) by which the cyan dot column CD and the yellow dot column YD come into contact each other at a single point, and another correction pattern is formed next to the certain correction pattern with a dot size from among the many printable dot sizes of the printer where the gap size between the cyan dot column CD and the yellow dot column YD is approximate to zero.

As shown in FIG. 14, the diameter (35 μm) of the dots of the fifth correction pattern P5 is the "theoretical diameter" and the other correction patterns P1 to P4 are formed with a dot size smaller than the theoretical diameter. At this time, the difference "0.8 μm" between the diameter (34.2 μm) of the dots of the fourth correction pattern P4 and the diameter (theoretical diameter) of the dots of the fifth correction pattern P5 is smaller than the difference "5.6 μm" between the diameter (22.2 μm) of the dots of the first correction pattern P1 and the diameter (27.8 μm) of dots of the second correction pattern P2. The diameter difference "2.4 μm" between dots of the fourth correction pattern P4 and the third correction pattern P3 is smaller than the diameter difference "5.6 μm" between dots of the first correction pattern P1 and the second correction pattern P2. In this manner, it is possible to form many correction patterns with dots having a size which is almost equal to the theoretical diameter.

Forming many correction patterns with dots having a size which is almost equal to the theoretical diameter means that it is easy to form the correction patterns by which it is possible to detect the inclination of the head 41 (or positional misalignment of plural heads) with a high degree of precision. For example, it is possible to detect the inclination of the head 41 by the other correction patterns P1 to P4 even in the cases where the correction patterns are not formed with the theoretical dots (dots as designed), the cyan dot column CD and the yellow dot column YD of the fifth correction pattern P5 widely overlap each other, and it is difficult to detect the inclination of the head 41 with the fifth correction pattern P5.

In the second test pattern, the correction patterns are formed with dots having sizes which are equal to or smaller than the "theoretical diameter." In the case in which the sizes of the dots is larger than the theoretical diameter, as shown in FIG. 9C, the overlapping portion of the cyan dot column CD positioned on the right side in the paper width direction and the yellow dot column YD positioned on the left side of the paper width direction must be compared with the overlapped portion of the yellow dot column YD positioned on the left side in the paper width direction and the cyan dot column CD positioned on the right side in the paper width direction, and furthermore it is difficult to detect the inclination of the head 41 (or positional misalignment of plural heads). That is, in the correction patterns formed with dots having sizes which are equal to or smaller than the theoretical diameter, it is easy to detect the inclination of the head 41 (or positional misalignment of plural heads) by determining whether the cyan dot column CD and the yellow dot column YD overlap, or whether a white stripe appears between the cyan dot column CD and the yellow dot column YD. That is, a plurality of correction patterns may be formed such that the cyan dot column CD and the yellow dot column YD of the correction pattern do not overlap each other. However, the structure of the correction pattern is not limited thereto. That is, the correction patterns may be formed with dots having sizes larger than the theoretical diameter. In particular, although the size of the dots is larger than the theoretical diameter, if the size of the dots is approximate to the theoretical diameter, it is easy to detect the inclination of the head 41 because a white stripe is formed between the cyan dot column CD and the yellow dot column YD even in response to just the slightest amount of inclination of the head 41.

Although the correction pattern is formed with dots having the theoretical diameter such that the cyan dot column CD and the yellow dot column YD contact each other at a single point, there is a possibility that a gap is created between the cyan dot column CD and the yellow dot column, or the cyan dot column CD and the yellow dot column YD overlap each other. For such a reason, in other words, it is desirable that the correction pattern is formed with dots having a size (diameter) as large as such that the gap size between the cyan dot column CD and the yellow dot column YD is zero. Further, when a user uses the printer 1, if the size of dots which causes the dot columns to be brought into contact with each other at a single point is used, a white stripe appears in the print image. Accordingly, the dot size must be increased. Accordingly, it is desirable that the drive signal COM for forming the test pattern (forming the dots of the theoretical diameter) and the drive signal for performing actual printing are differently set. In the printer 1, there is limitation in adjustment of the drive signal COM, and therefore there is a case in which the dots having the theoretical diameter cannot be formed. In such a printer 1, among printable dot sizes by the printer 1, the dot size (dot diameter) which makes the gap size between the cyan dot column CD and the yellow dot column become almost zero is selected, and the correction pattern may be formed with the selected dot size.

So far, according to theory (design), it is easy to detect the inclination of the head 41 or the positional misalignment of the plural heads by the correction pattern in which the cyan dot column CD and the yellow dot column come in contact with each other, and a larger number of correction patterns can be formed with dot sizes which is approximate to the theoretical diameter. However, the correction pattern is not limited thereto. That is, if there is a dot size which helps a user easily detect the inclination of the head 41 or the positional misalignment of plural heads, a larger number of correction patterns may be formed with dot sizes which are approximate to such a dot size. That is, the correction patterns may be formed with the dot size such that the gap between the cyan dot column CD and the yellow dot column YD is larger than a specified value. By doing so, it is possible to form correction patterns by which it is easy to detect the inclination of the head 41 and the positional misalignment of dots of the plural heads.

Third Exemplary Test Pattern

FIG. 15 is a view showing ink colors of dot columns constituting the correction pattern. In the third example, ink colors for forming the dot columns are differently set. The printer 1 of the present embodiment can discharge four colors of ink, yellow, magenta, cyan, and black. In the third example, two nozzle columns are selected among a yellow nozzle column Y, a magenta nozzle column M, and a cyan nozzle column C, and the correction pattern is formed with the selected nozzle columns.

In this manner, as the correction pattern is formed by two nozzle columns discharging different colors of ink, it is easy to detect an event in which two dot columns arranged in the paper width direction overlap each other in the correction pattern. For example, as shown in FIG. 15, in the case of forming the correction pattern by the cyan dot column CD and the yellow dot column YD, the overlapped portion of two dot columns is recognized as a green color. In the case of forming the correction pattern with the magenta dot column MD and the yellow dot column YD, the overlapped portion of two dot columns is recognized as a red color. In the case of forming the correction pattern with the cyan dot column CD and the magenta dot column MD, the overlapped portion of two dot columns is recognized as a blue color.

In the case of forming the correction pattern with two nozzle columns discharging the same color (for example, black) as shown in FIG. 15, since the overlapped portion and the portions that do not overlap are the same color, it is difficult to recognize the overlapped portion of the dot columns. In particular, since the dot columns which actually constitute the correction pattern are small, it is difficult to recognize the overlapping of the dot columns.

Accordingly, in the third example, the correction pattern is formed by two nozzle columns (corresponding to a first nozzle column and a second nozzle column) discharging different colors of ink. With such a structure, when the dot columns constituting the correction pattern overlap each other, a color (secondary color) different from colors of the dot columns formed by the two nozzle columns appears and therefore it is easy to check the overlapping of the dot columns. As a result, it is possible to more precisely detect the inclination of the head 41 or the positional misalignment of plural heads.

Out of two nozzle columns for forming the correction pattern, it is preferable that one nozzle column is a yellow nozzle column Y. The yellow dot column YD is relatively pale as compared to the magenta dot column MD and the cyan dot column CD. Accordingly, when the yellow dot column YD and the cyan dot column CD (or the magenta dot column MD) overlap each other, the pale yellow dot column YD changes to a strong green dot column or a strong red dot column (brightness is sharply lowered). That is, since the gray level change (brightness gradient) is sharp at a border area between the region at which the yellow dot column YD and the cyan dot column CD (or the magenta dot column MD) overlap each other and the region of the yellow dot column YD, it is easy to recognize the fact that the dot columns overlap each other. As a result, it is possible to detect with a high degree of precision the inclination of the head 41 or the positional misalignment of plural heads.

Further, the invention is not limited to the case in which the two nozzle columns are selected among the yellow, magenta, and cyan nozzle columns Y, M, and C to form the correction pattern. For example, there is a printer 1 discharging ink having the same black color but different brightness (dark black ink, medium-dark black ink, and pale black ink). In such a printer, if a dot column of a strong black ink and a dot column of another color ink (Y, M, or C) overlaps, the overlapped portion is recognized as a strong black color; if a dot column of a pale black ink and a dot column of another color ink (Y, M, or C) overlaps, a color of the overlapped portion becomes different from the color of the dot column of the pale black ink and the dot column of the ink Y, M, or C, and therefore it is possible to recognize the overlapping of the dot columns. In conclusion, it is possible to more precisely detect the inclination of the head 41 or the positional misalignment of plural heads.

Fourth Exemplary Test Pattern

Figure 16:
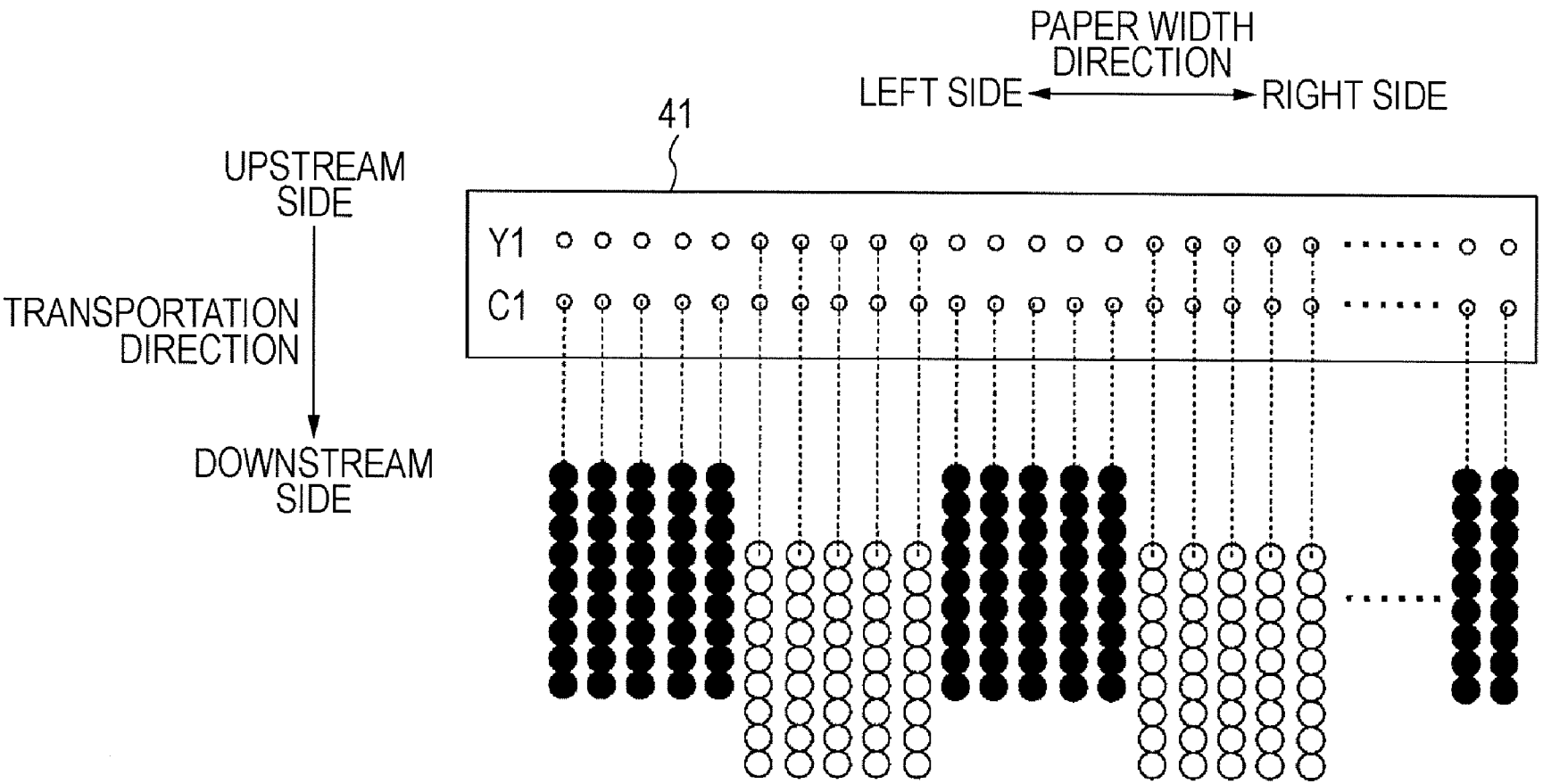
FIG. 16 is a view showing a fourth exemplary correction pattern.

FIG. 16 is a view showing a fourth exemplary correction pattern. So far, the description has been made with respect to a structure in which the cyan dot column CD and the yellow dot column YD constituting the correction pattern are alternately arranged in the paper width direction, but the correction pattern is not limited thereto. As shown in the figure, a plurality (5 lines) of cyan dot columns CD and a plurality (5 lines) of yellow dot columns YD may be alternately formed. Since the dot columns of the test pattern are actually very small, it is difficult to check the relative positional relationship between one cyan dot column CD and one yellow dot column YD. Accordingly, as the correction pattern, alternately forming a plurality of cyan dot columns CD and yellow dot columns YD in the paper width direction at predetermined intervals makes it easier for a user to detect the inclination of the head 41 or the positional misalignment of the plural heads.

To form such correction patterns, two nozzle columns need to be arranged in an intersecting direction with respect to the nozzle column direction rather than two nozzle columns not being spaced from each other in the paper width direction. For example, the fourth exemplary correction pattern can be formed by the upstream side yellow nozzle column Y1 of two yellow nozzle columns Y1 and Y2 and the upstream side cyan nozzle column C1 of the two cyan nozzle columns C1 and C2.

Other Adjustments of Head Unit 40

Figure 17A:
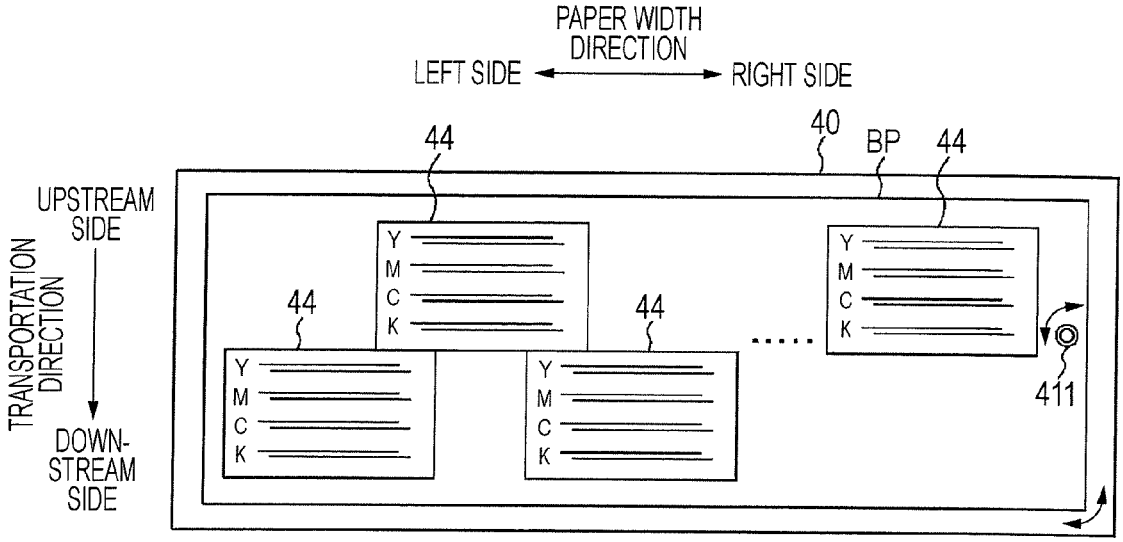
FIG. 17A is a view showing a head unit having a plurality of short heads and FIG. 17B is a view showing a state in which a head unit having a plurality of short heads is lined up in a transportation direction.

FIG. 17A is a view showing the head unit 40 having a plurality of short heads 44. So far, as shown in FIG. 3, described is the case for detecting the inclination of the head unit 40 having only one head 41 in which nozzles of each of nozzle columns are arranged in the paper width direction, but the invention is not limited thereto. For example, as shown in FIG. 17A, with a placement in which short heads 44 are placed in a zigzag form in the paper width direction, in the case of adjusting the inclination of the head unit 40 in which nozzles are arranged at the nozzle pitch (uniform interval) in the paper width direction, the test pattern of the present embodiment (for example, FIG. 11) can also be used. Further, it is possible to adjust the inclination of each of the short heads 44 provided in the head unit 40. It is also possible to adjust the inclination of the head unit 40 with respect to the moving direction of the paper transporting unit 20, when attaching the head unit 40, in which nozzle column directions of the short heads 44 are in parallel with each other, to the printer 1.

Figure 17B:
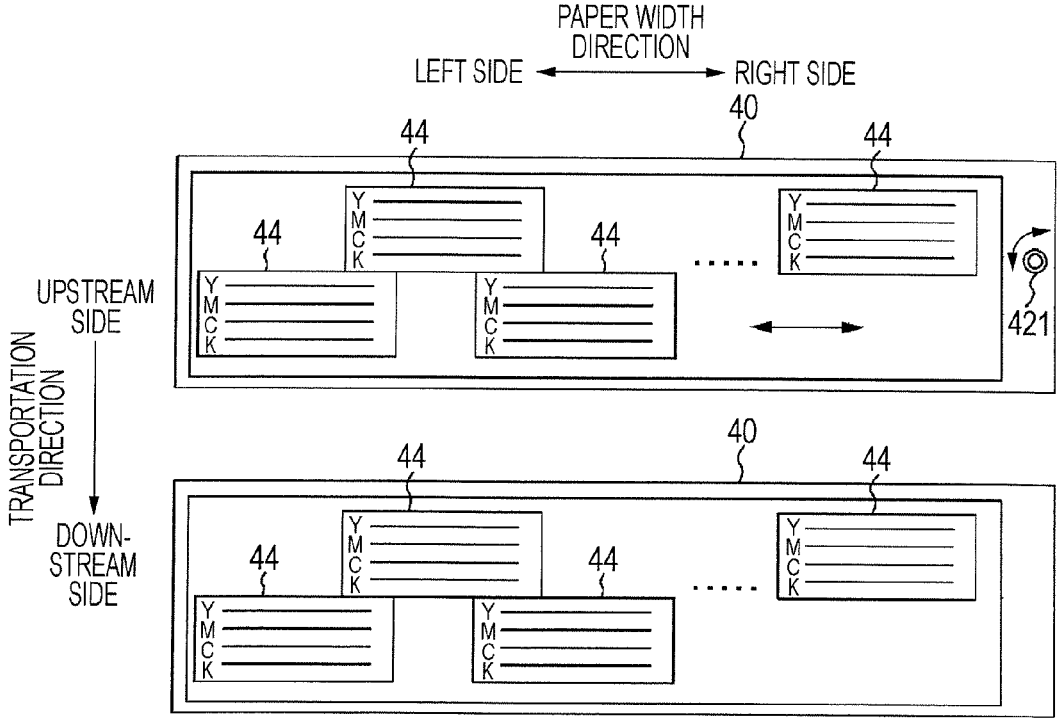

FIG. 17B is a view showing the structure in which the head unit 40 having a plurality of short heads 44 lined up in the transportation direction. So far, as shown in FIG. 6, the case described has been for detecting the positional misalignment in the paper width direction using two head units 40 which are disposed in one head 41 having nozzle columns in which nozzles are lined up in the paper width direction, but the invention is not limited thereto. For example, as shown in FIG. 17B, the case of detecting the positional misalignment between two head units 40 in the paper width direction, where each head unit having short heads 44 arranged in a zigzag form in the paper width direction, the test pattern of the present embodiment may be used. Further, it is possible to adjust the positional misalignment in the paper width direction between a certain short head 44 of the upstream side head unit 40 and a corresponding short head 44 of the downstream side head unit 40 head by head. It is also possible to adjust the positional misalignment in the paper width direction between the upstream side head unit 40 and the downstream side head unit 40 head by head. Further, these methods and manufacturing methods also fall into the scope of the application.

Other Embodiments

In the above embodiments, the printer 1 is exemplified but the printing device is not limited thereto. That is, the printing device may be realized as a liquid discharging device which ejects or discharges liquid (a liquid, a liquid material in which powder of a functional material is dispersed, a liquid material such as gel) other than ink. For example, the technique mentioned in the above description of the present embodiment may be applied to various devices using an ink jet technique, such as a color filter manufacturing device, a dying device, a micro-machining device, a semiconductor manufacturing device, a surface processing device, a three-dimensional modeling device, a gas vaporizing device, an organic EL manufacturing device (particularly polymer EL manufacturing device), a display manufacturing device, a film forming device, a DNA chip manufacturing device. Further, these methods and manufacturing methods of the above also fall into the scope of the application.

A liquid discharging method may be a piezoelectric method which discharges liquid such that a voltage is applied to drive elements (piezoelectric element) to expand or contract liquid chambers so that liquid is discharged from the liquid chambers, or a thermal method which discharges liquid such that air bubbles are generated in nozzles by thermal elements so that liquid is discharged by the air bubbles.

The above embodiment is provided to help people more easily understand the invention, so it must not be construed as a limitation of the invention. The advantage of the invention can be attained by changes, alterations, and modifications of the invention without departing from the spirit of the invention and it is apparent that the invention includes its equivalents. Further, the following is also inclined in the scope of the invention.

Nozzle Column

In the above-described embodiment, when forming the correction patterns shown in FIGS. 4 to 7, all of the nozzles in the nozzle columns Y1 and C2 used to form the correction patterns are used but the invention is not limited thereto. According to the kind of paper, ink may more easily spread on some kinds of paper than on other kinds. Further, it is difficult to recognize the positional relationship between the dot columns when the distance between the dot columns is too small. For such a reason, the correction pattern is formed with every n-th nozzles so that the distance between the dot columns is larger than the nozzle pitch (720 dpi). Further, although the nozzle columns (for example, Y1 and C2 of FIG. 3) used for forming the correction patterns are spaced from each other in the paper width direction, the invention is not limited thereto. For example, the correction pattern may be formed by the nozzle columns (for example, Y1 and C1 of FIG. 3) which are not spaced from each other in the paper width direction. Further, all of the nozzles belonging to two nozzle columns Y1 and C1 are numbered in order from the right side in the paper width direction, and the correction pattern may be formed by odd-numbered nozzles of the yellow nozzle column Y1 and even-numbered nozzles of the cyan nozzle column C1.

Although the correction pattern is formed by two nozzle columns discharging different colors of ink in the third exemplary test pattern, the invention is not limited thereto. The correction pattern may be formed by two nozzle columns discharging the same color of ink. In the printer separately discharging strong and pale ink (for example, a printer having a strong magenta nozzle column, a pale magenta nozzle column, a strong cyan nozzle column, and a pale cyan nozzle column), the correction pattern may be formed by two nozzle columns discharging the same color but different shadings of ink.

Serial Printer

In the above-described embodiment, a line head printer in which heads are arranged in the paper width direction which intersects the transportation direction of the medium is exemplified but the invention is not limited thereto. For example, in a serial printer in which an image forming operation for forming an image involves moving the head unit 40, in which a single or a plurality of heads is installed, in the moving direction which intersects the transportation direction of the medium, and a transporting operation for transporting the medium are alternately performed, the inclination of the head or the misalignment of the nozzle column direction may be detected on the basis of the above test pattern.

What is claimed is:

1. A printing device comprising:

a first nozzle column in which nozzles discharging liquid to a medium are arranged in a line in a first direction;

a second nozzle column in which nozzles discharging liquid to the medium are arranged in a line in the first direction, in which the first and second nozzle columns are arranged in a second direction intersecting with the first direction;

a control portion which causes the first nozzle column and the second nozzle column to discharge the liquid to the medium while moving at least one of the medium and a set of the first and second nozzle columns so that the medium and the set of the first and second nozzle columns move relatively to each other in a moving direction which is along the second direction, wherein the control portion forms a first correction pattern composed of a first pattern formed by the first nozzle column along the moving direction and a second pattern formed by the second nozzle column along the moving direction in parallel with the first pattern with the second pattern being offset from the first pattern in a direction intersecting with the moving direction, and the control portion forms a second correction pattern composed of a third pattern formed by the first nozzle column along the moving direction and a fourth pattern formed by the second nozzle column along the moving direction in parallel with the third pattern with the third pattern being offset from the fourth pattern in the direction intersecting with the moving direction, the control portion differentiates a distance in the first correction pattern between the first pattern and the second pattern with respect to the direction intersecting with the moving direction from a distance in the second correction pattern between the third pattern and the fourth pattern with respect to the direction intersecting with the moving direction by changing a size of dots formed by the first and second nozzle columns in the first correction pattern from a size of dots formed by the first and second nozzle columns in the second correction pattern.

2. The printing device according to claim 1, wherein, out of the dot sizes which can be formed by the printing device, the control portion forms the first correction pattern with dots having sizes as large as that the distance in the first correction pattern approximately is zero.

3. The printing device according to claim 2, wherein, out of the dot sizes which can be printed by the printing device, the control portion forms the second correction pattern with dots having sizes as large as that the distance in the second correction pattern is almost zero.

4. The printing device according to claim 1, wherein, out of the dot sizes which can be formed by the printing device, the control portion forms the first correction pattern with dots having sizes as large as that the distance in the first correction pattern is approximate to a predetermined value.

5. The printing device according to claim 1, wherein the control portion forms the first correction pattern such that the first pattern and the second pattern of the first correction pattern do not overlap each other and the second correction pattern such that the third pattern and the fourth pattern of the second correction pattern do not overlap each other.

6. The printing device according to claim 1, wherein a color of liquid discharged from the first nozzle column and a color of liquid discharged from the second nozzle column are different from each other.

7. The printing device according to claim 6, wherein the color of the liquid discharged from the first nozzle column is yellow.

8. A printing method of a printing device having a first nozzle column in which nozzles discharging liquid to a medium are arranged in a line in a first direction, a second nozzle column in which nozzles discharging liquid to a medium are arranged in a line in the first direction and which is in parallel with the first nozzle column in a second direction intersecting with the first direction, and a control portion for discharging liquid to a medium while moving at least one of the medium and a set of the first and second nozzle columns so that the medium and the set of the first and second nozzle columns move relatively to each other in a moving direction which is along the second direction, the printing method comprising:

forming a first correction pattern composed of a first pattern formed by the first nozzle column along the moving direction and a second pattern formed by the second nozzle column along the moving direction in parallel with the first pattern with the second pattern being offset from the first pattern in a direction intersecting with the moving direction;

forming a second correction pattern composed of a third pattern formed by the first nozzle column along the moving direction and a fourth pattern formed by the second nozzle column along the moving direction in parallel with the third pattern with the third pattern being offset from the fourth pattern in the direction intersecting with the moving direction; and changing a size of dots formed by the first and second nozzle columns in the first correction pattern from a size of dots formed by the first and second nozzle columns in the second correction pattern to differentiate a distance between the first pattern and the second pattern with respect to the direction intersecting with the moving direction from a distance in the second correction pattern between the third pattern and the fourth pattern with respect to the direction intersecting with the moving direction.

* * * * *